US011540622B2

(12) United States Patent
Choi

(10) Patent No.: US 11,540,622 B2
(45) **Date of Patent: *Jan. 3, 2023**

(54) LINKING ASSEMBLY, FOLDABLE FRAME AND PICNIC TABLE HAVING SAME

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/142,741

(22) Filed: Jan. 6, 2021

(65) Prior Publication Data

US 2021/0274930 A1 Sep. 9, 2021

(30) Foreign Application Priority Data

Mar. 5, 2020 (CN) ..... 202020261462.X
Mar. 5, 2020 (CN) ..... 202020261535.5
Apr. 9, 2020 (CN) ..... 202020513759.0

(51) Int. Cl.
*A47B 3/14* (2006.01)
*A47B 3/091* (2006.01)

(52) U.S. Cl.
CPC ..... *A47B 3/14* (2013.01); *A47B 3/0913* (2013.01)

(58) Field of Classification Search
CPC ... A47B 3/14; A47B 3/0912; A47B 2003/145; A47B 2003/0835; A47C 11/00
USPC ..... 297/158.4
See application file for complete search history.

(56) References Cited

U.S. PATENT DOCUMENTS 3,276,815 A * 10/1966 Cardy ..... A47C 9/06 297/158.4
3,574,393 A * 4/1971 Hughes ..... A47B 3/14 108/35
5,921,623 A 7/1999 Nye
6,347,831 B1 2/2002 Nye
6,644,734 B1 11/2003 Tseng
6,843,183 B2 * 1/2005 Strong ..... A47B 9/14 248/188.5
8,132,517 B2 3/2012 Leng
10,159,334 B1 12/2018 Wang
10,206,496 B1 * 2/2019 Miller ..... A47B 3/14
D895,345 S * 9/2020 Leng ..... D7/337
2004/0070235 A1 4/2004 Gregory
2004/0195869 A1 10/2004 Zhurong
2004/0227382 A1 * 11/2004 Lin ..... A47B 83/02 297/158.4

(Continued)

*Primary Examiner* — Jose V Chen
(74) *Attorney, Agent, or Firm* — Morgan, Lewis & Bockius LLP

(57) ABSTRACT

A foldable frame includes a table frame, one or more bench frames, and first and second leg assemblies to support the table and bench frames. Each of the first and second leg assemblies include one or more table legs and one or more bench legs generally shorter than the one or more table legs. The foldable frame also includes a plurality of linking assemblies to connect the bench legs to the one or more bench frames so that each of the first and second leg assemblies can be rotated as a single unit. When unfolded, the table and bench frames are placed at different heights. When folded, the table and bench frames are placed at a common plane with the first and second leg assemblies folded onto the common plane. The foldable frame is easy to use and convenient for transportation and storage.

22 Claims, 30 Drawing Sheets

(56) References Cited

U.S. PATENT DOCUMENTS

| | | | | |
|---|---|---|---|---|
| 2006/0181114 | A1* | 8/2006 | Nye | A47B 37/04 297/158.3 |
| 2008/0018142 | A1* | 1/2008 | Yul | A47B 85/04 108/11 |
| 2017/0340100 | A1 | 11/2017 | Tsai | |
| 2021/0106132 | A1* | 4/2021 | Chen | A47B 9/14 |
| 2021/0112967 | A1* | 4/2021 | Leng | A47B 3/14 |
| 2021/0112968 | A1 | 4/2021 | Ponomar | |
| 2021/0177135 | A1 | 6/2021 | Leng | |
| 2021/0274929 | A1 | 9/2021 | Choi | |
| 2021/0274930 | A1 | 9/2021 | Choi | |

* cited by examiner

LINKING ASSEMBLY, FOLDABLE FRAME AND PICNIC TABLE HAVING SAME

CROSS-REFERENCE TO RELATED APPLICATIONS

The present application claims priority to Chinese Utility Model Applications CN 202020261462.X filed Mar. 5, 2020, CN 202020261535.5 filed Mar. 5, 2020, and CN 202020513759.0 filed Apr. 9, 2020. The disclosure of each application is incorporated herein for all purposes by reference in its entirety.

FIELD OF THE INVENTION

The present invention generally relates to frames and in particular to foldable frames for picnic tables.

BACKGROUND

Picnic tables have been used for a long time. A picnic table generally includes a tabletop, one or more benchtops, and leg assemblies to support the tabletop and benchtops. In order to provide both a table and seating to people, the leg assemblies usually include table and bench legs having different lengths for supporting the tabletop and benchtops at different heights. Because of this difference in length and height, many existing picnic tables are not foldable and are difficult to carry around. As such, they are often placed outdoors at certain permanent locations. Consequently, the lifetime of the picnic tables are shortened significantly due to the long time exposure to the outdoor environment. Some existing picnic tables are foldable. However, because of the difference in length and height, a leg assembly often cannot be folded or unfolded as one unit and, in some cases, the table and bench legs of a leg assembly have to be folded or unfolded separately. As a result, folding and unfolding of the picnic tables is not simple or easy, and accordingly the picnic tables are inconvenient to use.

Given the current state of the art, there remains a need for foldable frames and tables that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides foldable frames that are simple and easy to fold and unfold.

In various exemplary embodiments, the present disclosure provides a foldable frame including a table frame, a first bench frame, first and second linking assemblies, and first and second leg assemblies. The first linking assembly is connected to the first bench frame at a first side of the foldable frame and the second linking assembly is connected to the first bench frame at a second side of the foldable frame. Each of first and second leg assemblies includes one or more table legs, a first bench leg, and a leg-linking member connecting the first bench leg with the one or more table legs. The first bench leg has a length shorter than the one or more table legs. The one or more table legs of the first leg assembly are pivotally coupled with the table frame at the first side of the foldable frame. The first bench leg of the first leg assembly is pivotally coupled with the first linking assembly. The one or more table legs of the second leg assembly are pivotally coupled with the table frame at the second side of the foldable frame. The first bench leg of the second leg assembly is pivotally coupled with the second linking assembly. As such, the first linking assembly allows the first leg assembly to rotate as one unit and the second linking assembly allows the second leg assembly to rotate as another one unit. When the first and second leg assemblies are unfolded, the first bench frame is positioned lower than the table frame.

In an exemplary embodiment, the first bench leg of the first or second leg assembly is integrally formed with the leg-linking member.

In some exemplary embodiments, the foldable frame further includes a second bench frame, a third linking assembly and a fourth linking assembly. The second bench frame is disposed at a side of the table frame opposite to the first bench frame. The third linking assembly is connected to the second bench frame at the first side of the foldable frame and the fourth linking assembly is connected to the second bench frame at the second side of the foldable frame. In such embodiments, each of the first and second leg assemblies further includes a second bench leg shorter than the one or more table legs and connected to the one or more table legs by the leg-linking member. The second bench leg of the first leg assembly is pivotally coupled with the third linking assembly, and the second bench leg of the second leg assembly is pivotally coupled with the fourth linking assembly. As such, the first and third linking members collectively allow the first leg assembly to rotate as one unit, and the second and fourth linking members collectively allow the second leg assembly to rotate as another one unit. When the first and second leg assemblies are unfolded, both of the first and second bench frames are positioned lower than the table frame.

In an exemplary embodiment, the first and second bench legs of a respective leg assembly in the first and second leg assemblies have a same length or different lengths.

In some exemplary embodiments, the foldable frame further includes first and second supporting assemblies. The first supporting assembly is pivotally connected to the first leg assembly and table frame and configured to control rotation of the first leg assembly with respect to the table frame and to help support the table frame when the first leg assembly is unfolded. The second supporting assembly is pivotally connected to the second leg assembly and table frame and configured to control rotation of the second leg assembly with respect to the table frame and to help support the table frame when the second leg assembly is unfolded.

In some exemplary embodiments, the first linking assembly is pivotally connected to the first bench frame at the first side of the foldable frame and the first bench leg of the first leg assembly is pivotally connected to the first linking assembly such that an upper end portion of the first bench leg of the first leg assembly abuts the first bench frame when the first leg assembly is unfolded and separates from the first bench frame when the first leg assembly is folded. The second linking assembly is pivotally connected to the first bench frame at the second side of the foldable frame and the first bench leg of the second leg assembly is pivotally connected to the second linking assembly such that an upper end portion of the first bench leg of the second leg assembly abuts the first bench frame when the second leg assembly is unfolded and separates from the first bench frame when the second leg assembly is folded.

In some exemplary embodiments, the first bench frame includes a first bench-lateral member at the first side of the foldable frame and a second bench-lateral member at the second side of the foldable frame. The first linking assembly is pivotally connected to the first bench frame adjacent to the first bench-lateral member such that the upper end portion of the first bench leg of the first leg assembly abuts first bench-lateral member of the first bench frame when the first leg assembly is unfolded and separates from the first bench-lateral member of the first bench frame when the first leg assembly is folded. The second linking assembly is pivotally connected to the first bench frame adjacent to the second bench-lateral member such that the upper end portion of the first bench leg of the second leg assembly abuts the second bench-lateral member of the first bench frame when the second leg assembly is unfolded and separates from the second bench-lateral member of the first bench frame when the second leg assembly is folded.

In some exemplary embodiments, the first bench frame further includes first and second bench-longitudinal members spaced apart from each other. The first and second bench-lateral members are connected to or integrally formed with the first and second bench-longitudinal members. Each of the first and second linking assemblies is pivotally connected to at least one of the first and second bench-longitudinal members.

In some exemplary embodiments, a respective linking assembly in the first and second linking assemblies includes first and second linking members. The first linking member has a first end portion pivotally connected to the first bench-longitudinal member adjacent to a corresponding bench-lateral member in the first and second bench-lateral members. The second linking member has a first end portion pivotally connected to the second bench-longitudinal member adjacent to the corresponding bench-lateral member. The first bench leg of a corresponding leg assembly in the first and second leg assemblies is pivotally connected to second end portions of the first and second linking members.

In some exemplary embodiments, an engaging member is disposed at the upper end portion of the first bench leg of the corresponding leg assembly and configured to abut the corresponding bench-lateral member when the corresponding leg assembly is unfolded.

In an exemplary embodiment, the engaging member includes a first segment and a second segment bended with respect to the first segment. When the corresponding leg assembly is unfolded, the first segment abuts a lower side of the corresponding bench-lateral member to support the first bench frame, and the second segment abuts an interior side of the corresponding bench-lateral member to help prevent separation of the first bench leg from the corresponding bench-lateral member or to help stabilize the first bench leg of the corresponding leg assembly.

In an exemplary embodiment, the corresponding linking assembly further includes a third linking member disposed between the first and second linking member, and connected to or integrally formed with the first and second linking members.

In some exemplary embodiments, a respective linking assembly in the first and second linking assemblies includes a first bar fixedly coupled with the first bench frame and a second bar telescopically coupled with the first bar. The first bench leg of a corresponding leg assembly in the first and second leg assemblies is pivotally coupled with the second bar. As such, movement of the second bar with respect to the first bar allows the corresponding leg assembly to rotate as a unit.

In some exemplary embodiments, the first bench frame includes first and second bench-longitudinal members spaced apart in a first direction, and a plurality of bench-lateral members spaced apart in a second direction and connected to the first and second bench-longitudinal members. The first bar of the corresponding linking assembly is fixedly connected to one or more bench-lateral members in the plurality of bench-lateral members.

In an exemplary embodiment, the plurality of bench-lateral members includes first, second, third and fourth bench-lateral members. The first bar of the first linking assembly is fixedly connected to the first and second bench-lateral members, and the first bar of the second linking assembly is fixedly connected to the third and fourth bench-lateral members.

In an exemplary embodiment, the first bench leg of the corresponding leg assembly is pivotally coupled with the second bar by a coupler disposed at a distal end portion of the second bar.

In some exemplary embodiments, a respective linking assembly in the first and second linking assemblies includes one or more bars each coupled with the first bench frame, and a slider coupled with the one or more bars and movable along the one or more bars. The first bench leg of a corresponding leg assembly in the first and second leg assemblies is pivotally coupled with the slider. As such, movement of slider along the one or more bars allows the corresponding leg assembly to rotate as a unit.

In some exemplary embodiments, the one or more bars include first and second bars substantially parallel to each other. The slider includes a first sleeve to sleeve on the first bar, a second sleeve to sleeve on the second bar, and a slot between the first and second sleeves in the second direction to receive and pivotally couple with an upper end portion of the first bench leg.

In some exemplary embodiments, the first bench frame includes first and second bench-longitudinal members spaced apart in a first direction. The first bench frame also includes first, second, third and fourth bench-lateral members spaced apart in a second direction and connected to the first and second bench-longitudinal members. Each of the one or more bars of the first linking assembly is fixedly connected to the first and second bench-lateral members, and each of the one or more bars of the second linking assembly is fixedly connected to the third and fourth bench-lateral members.

In an exemplary embodiment, the first and second bench-lateral members are positioned such that the slider of the first linking assembly contacts the first bench-lateral member when the first leg assembly is unfolded and contacts the second bench-lateral member when the first leg assembly is folded. The third and fourth bench-lateral members are positioned such that the slider of the second linking assembly contacts the fourth bench-lateral member when the second leg assembly is unfolded and contacts the third bench-lateral member when the first leg assembly is folded.

The supporting assemblies, frames and tables of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

Figure 1A:
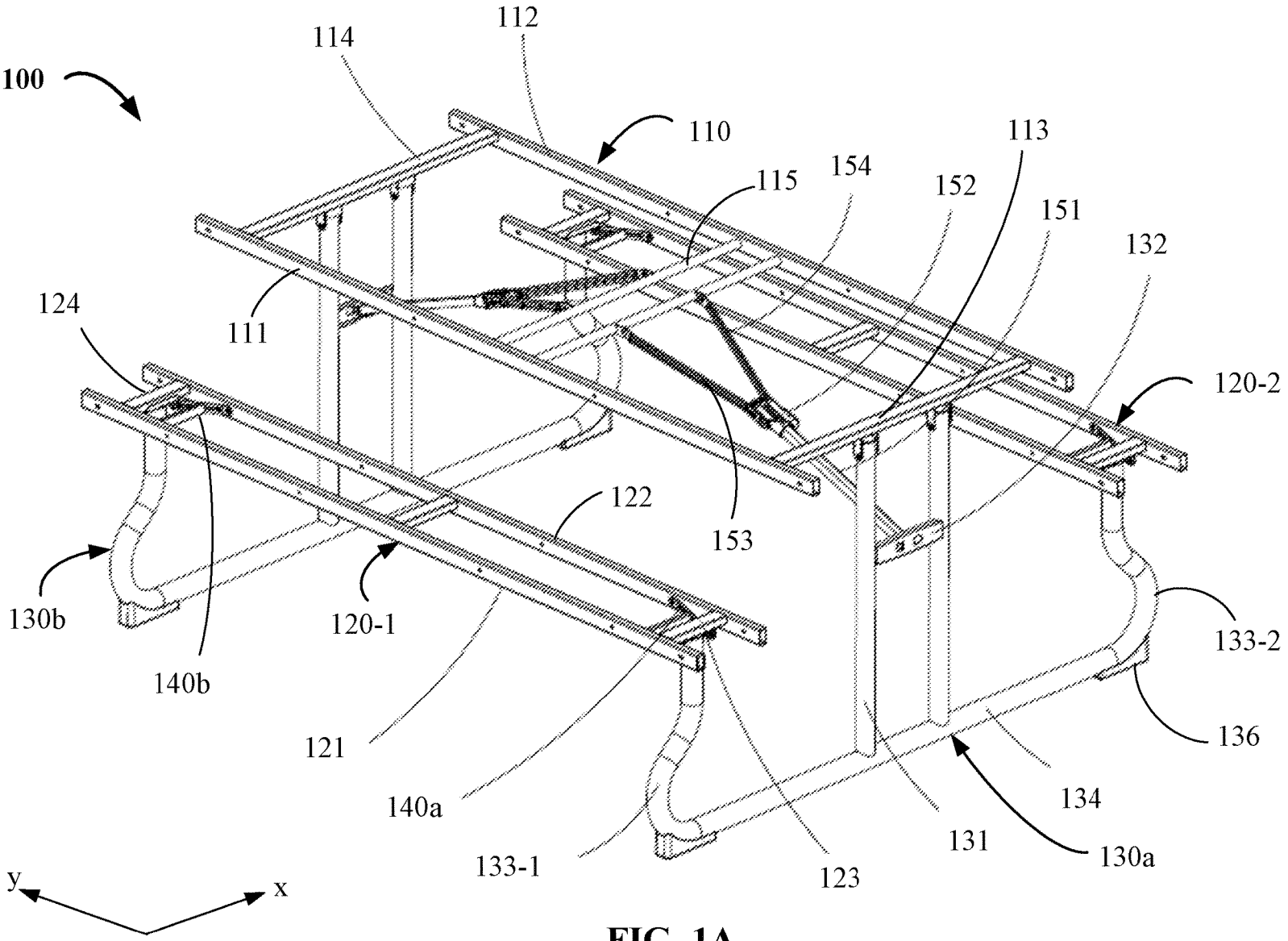
FIG. 1A is a perspective view illustrating an exemplary foldable frame in an unfolded state in accordance with exemplary embodiments of the present disclosure.
Figure 1B:
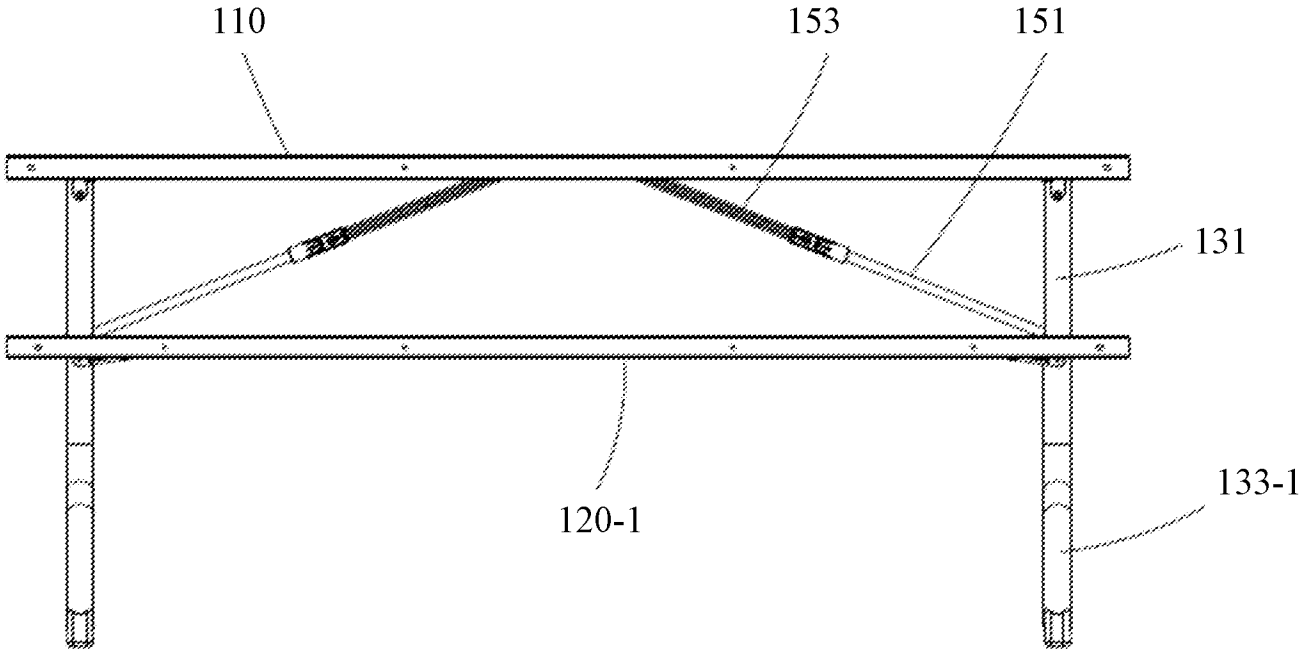
FIG. 1B is a side view illustrating the foldable frame of FIG. 1A in an unfolded state in accordance with exemplary embodiments of the present disclosure.

As will be apparent to those of skill in the art, the components illustrated in the figures or disclosed herein are combinable in any useful number and combination. The figures are intended to be illustrative in nature and are not limiting.

DETAILED DESCRIPTION

Reference will now be made in detail to implementation of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present disclosure are described in the context of foldable frames. A foldable frame generally includes a table frame, one or more bench frames, and first and second leg assemblies to support the table and bench frames. Each of the first and second leg assemblies includes one or more table legs and one or more bench legs. The one or more bench legs are generally shorter than the one or more table legs. The one or more bench legs can have the same length or different lengths.

The foldable frame also includes a plurality of linking assemblies configured to connect the bench legs to the one or more bench frames so that each of the first and second leg assemblies can be rotated between a use position and a storage position as a single unit even though the table and bench legs are at different lengths. This significantly simplifies the folding and unfolding processes, making the foldable frames of the present disclosure very easy to use. Moreover, the linking assemblies allow the table and bench frames to be placed at different heights when the first and second leg assemblies are unfolded. Further, the linking assemblies allow the table and bench frames to be placed at a common plane with the first and second leg assemblies folded onto the common plane. As a result, when folded, the foldable frame (and thus a picnic table using the foldable frame) becomes a compact panel-like structure and hence is very convenient for transportation and storage.

In some exemplary embodiments, the foldable frame further includes first and second supporting assemblies, each pivotally coupled with the table frame and a corresponding table leg assembly in the first and second leg assemblies. Each supporting assembly is configured to control rotation of the corresponding table leg assembly or prevent accidental folding/unfolding of the corresponding table leg assembly. As such, the supporting assemblies and other additional/optional structures help stabilize and support the leg assemblies when unfolded and thus enhance the stability of the foldable frames when in use.

The foldable frames of the present disclosure can be made of various materials including but not limited to metals (e.g., iron, steel, and aluminum) and plastics. In some exemplary embodiments, some components of a foldable frame (e.g., bars) are made of metals or the like while some other components (e.g., sliders) are made of plastics, rubbers or the like.

The foldable frame can be used to make a picnic table or the like. For instance, the table frame can be used to support a table panel and each bench frame in the one or more bench frames can be used to support a bench panel. The table and bench frames, and the table and/or bench panels can be of various shapes including but not limited to a square shape, a round shape or a rectangular shape. The panels can be made of various materials including but not limited to metals, plastics and woods. In some exemplary embodiments, the panels are made of plastics by injection molding, blow molding or any other suitable processes.

In some exemplary embodiments, the leg assemblies are configured such that the picnic table using the foldable frame can be folded multiple times into a generally layered block-like structure, with each bench panel is laid on the table panel either face-to-face or back-to-back with the table panel. As such, the foldable frame and picnic table when folded are compact, portable and easy to carry around.

Referring now to FIGS. 1A-3B, there is depicted exemplary foldable frame 100 in accordance with some exemplary embodiments of the present disclosure. Foldable frame 100 includes a table frame such as table frame 110, which can be used to support a table panel. In some exemplary embodiments, the table frame includes a plurality of mounting members connected to or integrally formed with each other. For instance, in some exemplary embodiments, table frame 110 includes first table-mounting member 111, second table-mounting member 112, third table-mounting member 113 and fourth table-mounting member 114. The first and second table-mounting members are spaced apart in a first direction, and the third and fourth table-mounting members are spaced apart in a second direction, e.g., the x and y directions in FIG. 1A. The second direction is different than the first direction. In some exemplary embodiments, the second direction is substantially perpendicular to the first direction. In an exemplary embodiment, the third and fourth table-mounting members are connected, respectively, to the first and second table-mounting members at first and second sides of the foldable frame, e.g., the right and left sides in FIG. 1B.

In some exemplary embodiments, table frame 110 includes additional, optional or alternative components. For instance, in an exemplary embodiment, table frame 110 includes one or more table-connecting members such as table-connecting member 115. The table-connecting member is connected to or integrally formed with the first and second mounting members.

Foldable frame 100 also includes one or more bench frames, which can be used to support one or more bench panels. In an exemplary embodiment, the foldable frame includes a single bench frame. In another exemplary embodiment, the foldable frame includes two or more bench frames. By way of example, foldable frame 100 is illustrated with first bench frame 120-1 and second bench frame 120-2. The first and second bench frames can be but do not necessarily have to be identical or symmetrical with respect to each other. By way of example, first bench frame 120-1 and second bench frame 120-2 are illustrated to be substantially identical.

In some exemplary embodiments, each bench frame includes a plurality of bench-mounting members connected to or integrally formed with each other. For instance, in some exemplary embodiments, each of the first and second bench frames includes first bench-longitudinal member 121, second bench-longitudinal member 122, first bench-lateral member 123 and second bench-lateral member 124. In an exemplary embodiment, the first and second bench-longitudinal members are spaced apart from each other, e.g., in the first direction. The first bench-lateral member is connected to or integrally formed with the first and second bench-longitudinal members at the first side of the foldable frame. The second bench-lateral member is connected to or integrally formed with the first and second bench-longitudinal members at the second side of the foldable frame. For instance, in an exemplary embodiment, each of the first and second bench-lateral member is disposed between the first and second bench-longitudinal members, and has an end portion connected to or integrally formed with the first bench-longitudinal member and another end portion connected to or integrally formed with the second bench-longitudinal member.

Foldable frame 100 further includes a first leg assembly such as first leg assembly 130*a* and a second leg assembly such as second leg assembly 130*b*. The first and second leg assemblies can be but do not necessarily have to be identical or symmetrical with respect to each other. By way of example, first leg assembly 130*a* and second leg assembly 130*b* are illustrated to be substantially identical.

In some exemplary embodiments, each of the first and second leg assemblies includes one or more table legs such as table leg 131. The one or more table legs are pivotally connected with the table frame. For instance, in some exemplary embodiments, the one or more table legs of the first leg assembly is pivotally connected to third table-mounting member 113 and the one or more table legs of the second leg assembly is pivotally connected to fourth table-mounting member 114. In an exemplary embodiment, a table leg of the first or second leg assembly is connected to the third or fourth table-mounting member by a coupler such as coupler 116. In an exemplary embodiment, each of the first and second leg assemblies includes two table legs 131 and table leg lateral bar 132 disposed between and connected to the two table legs.

In some exemplary embodiments, corresponding to each bench frame in the one or more bench frames, each of the first and second leg assemblies also includes a bench leg. The bench leg is generally shorter than the one or more table legs. For instance, in the illustrated embodiment with two bench frames, each of the first and second leg assemblies includes a first bench leg such as first bench leg 133-1 and a second bench leg such as second bench leg 133-2. First bench leg 133-1 is configured to support first bench frame 120-1 and second bench leg 133-2 is configured to support second bench frame 120-2.

The bench leg is generally shorter than the one or more table legs. However, the first and second bench legs can be but do not necessarily have to be identical or symmetrical with respect to each other. For instance, the first and second bench legs can have different lengths such that when the foldable frame is unfolded, the first and second bench frames can be placed at different heights to meet different needs. By way of example, first bench leg 133-1 and second bench leg 133-2 are illustrated to be substantially identical.

In some exemplary embodiments, the one or more table legs and the one or more bench legs are connected to or formed with each other so that the first or second leg assembly can rotate as one unit. For instance, in some exemplary embodiments, the one or more table legs and the one or more bench legs are connected to each other by a leg-linking member such as leg-linking member 134. In an exemplary embodiment, the first or second bench leg is integrally formed with the leg-linking member, for instance, by bending a bar. A bar can be solid, hollow or partially hollow and can have any suitable shapes and sizes. In another exemplary embodiment, both of the first and second bench legs are integrally formed with the leg-linking member.

The first or second leg assembly can include additional, optional or alternative components. For instance, in some exemplary embodiments, each of the first and second leg assemblies includes one or more anti-slip members (e.g., pad, tape, mat, tube, block or the like), such as anti-slip member 136, disposed at a bottom of the first or second leg assembly. The one or more anti-slip members prevent slips, reduce shakings and help stabilize the foldable frame when in use.

Figure 2A:
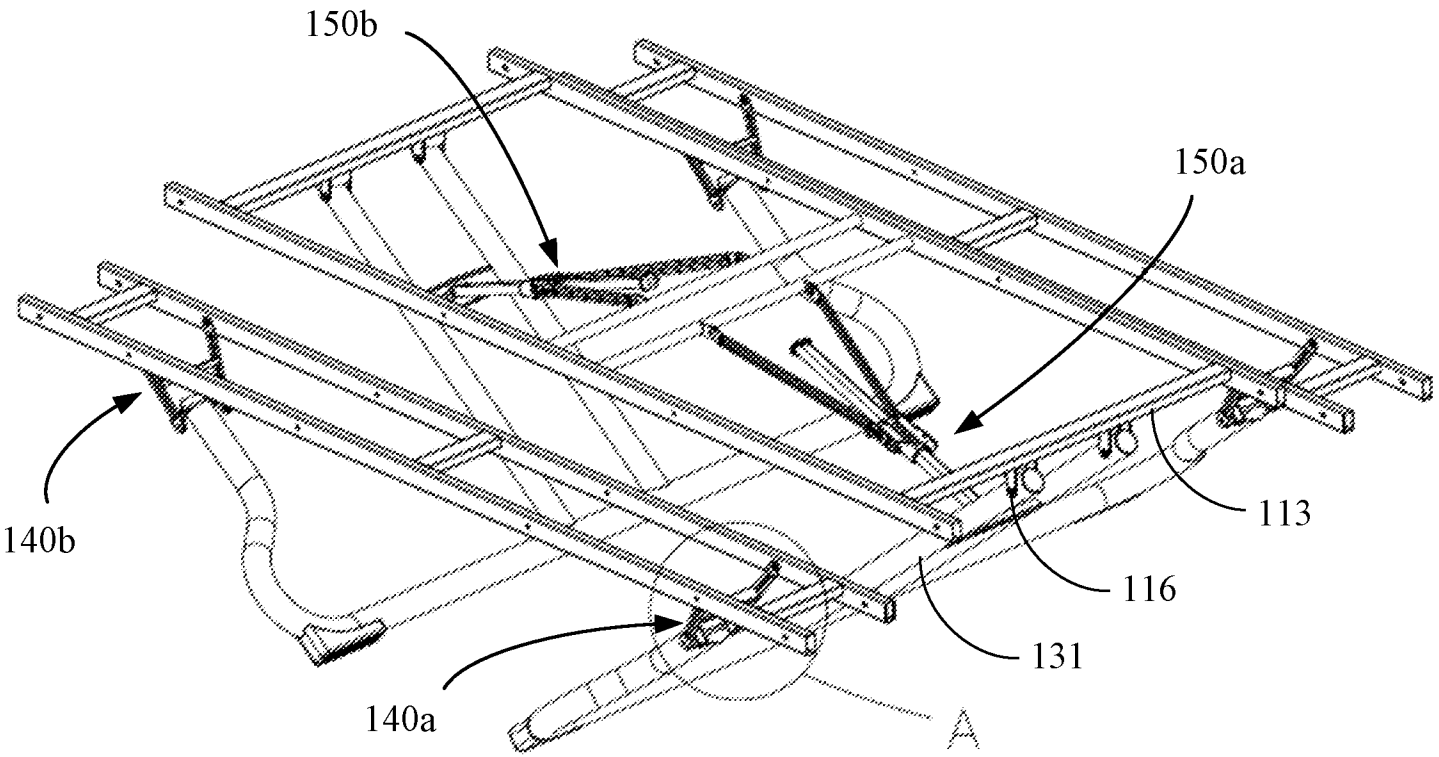
FIG. 2A is a perspective view illustrating the foldable frame of FIG. 1A in an intermediate state in accordance with exemplary embodiments of the present disclosure.
Figure 2B:
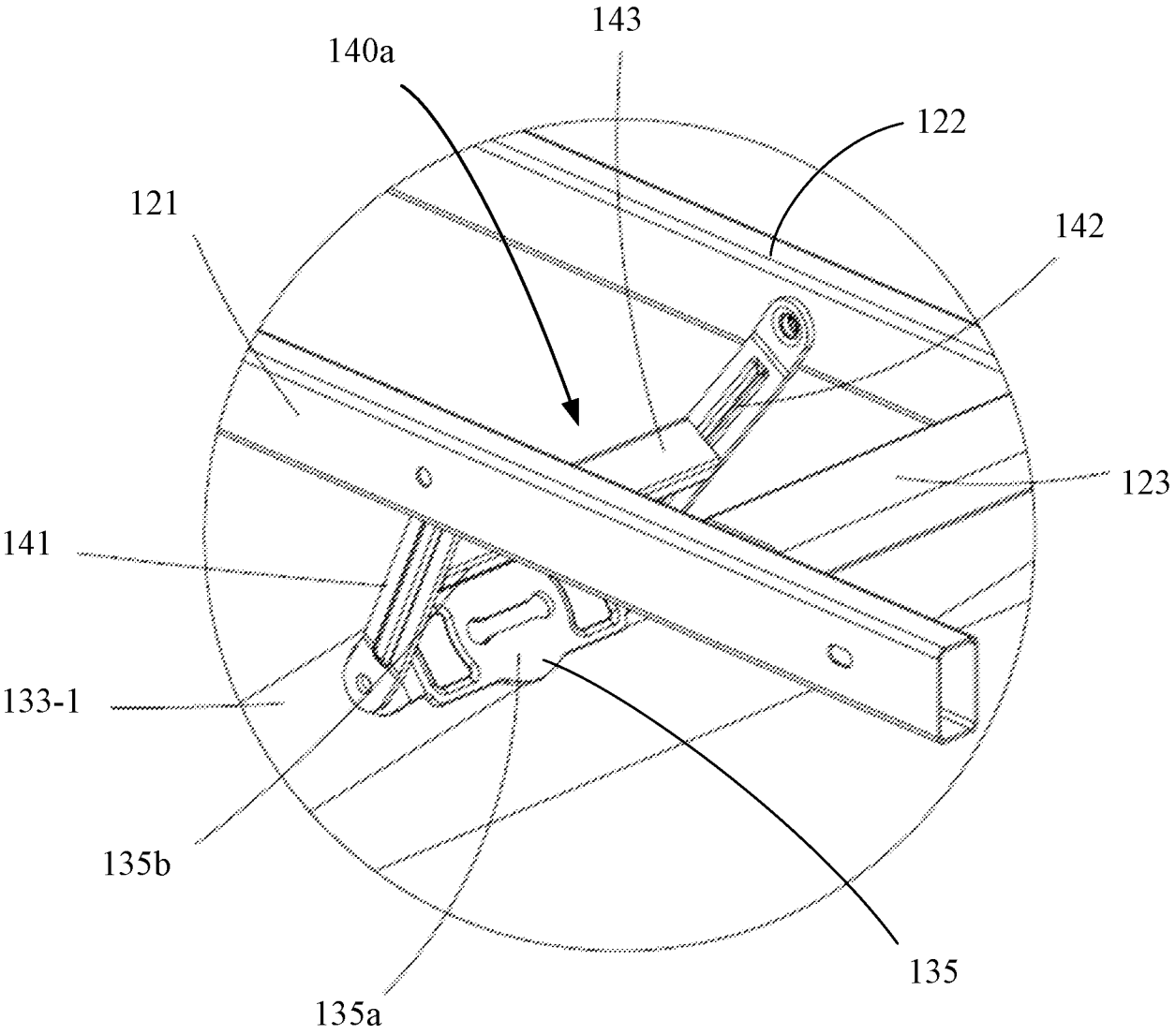
FIG. 2B is a partially enlarged view taken along circle A of FIG. 2A.
Figure 2C:
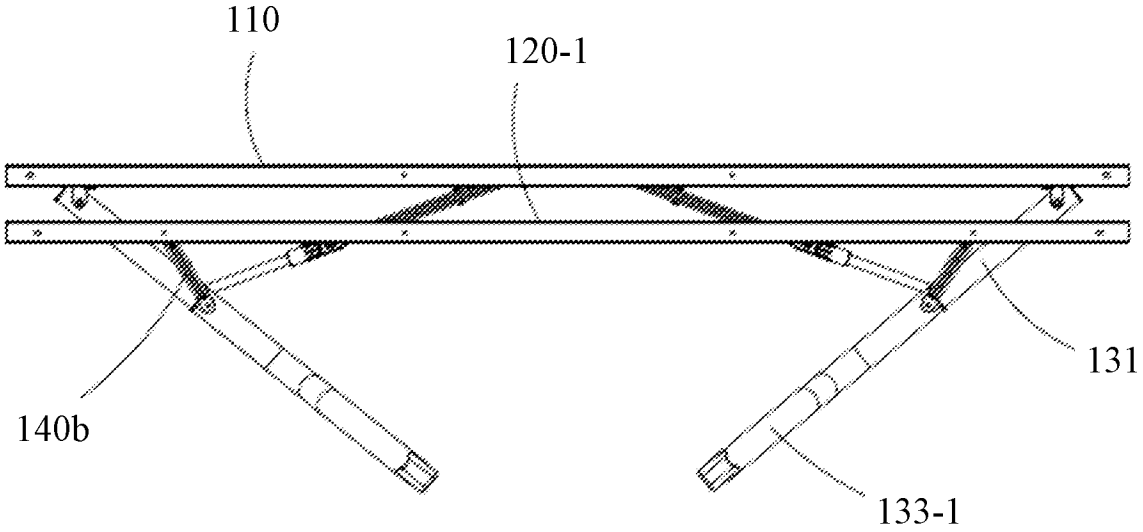
FIG. 2C is a side view illustrating the foldable frame of FIG. 1A in an intermediate state in accordance with exemplary embodiments of the present disclosure.

Referring in particular to FIGS. 2A and 2B, foldable frame 100 further includes a plurality of linking assemblies configured to connect the bench legs of the first and second leg assemblies to the one or more bench frames. In some exemplary embodiments, corresponding to each respective bench frame in the one or more bench frames, there are two linking assemblies, one connecting a corresponding bench leg of the first leg assembly to the respective bench frame and the other connecting a corresponding bench leg of the second leg assembly to the respective bench frame. For instance, in the illustrated embodiment, corresponding to first bench frame 120-1, foldable frame 100 includes first linking assembly 140*a* and second linking assembly 140*b*. The first and second linking assemblies can be but do not necessarily have to be identical or symmetrical with respect to each other. By way of example, first linking assembly 140*a* and second linking assembly 140*b* are illustrated to be substantially identical.

Figure 3A:
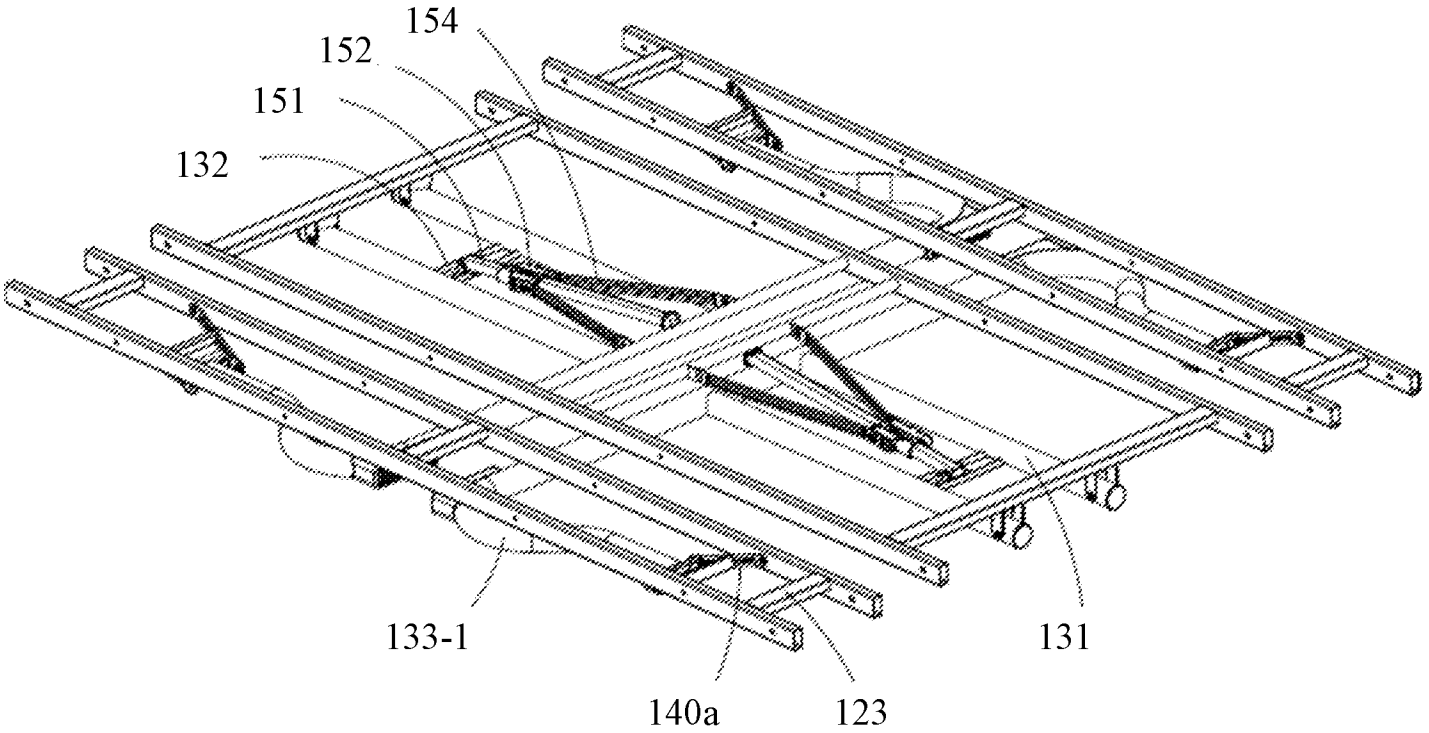
FIG. 3A is a perspective view illustrating the foldable frame of FIG. 1A in a folded state in accordance with exemplary embodiments of the present disclosure.
Figure 3B:
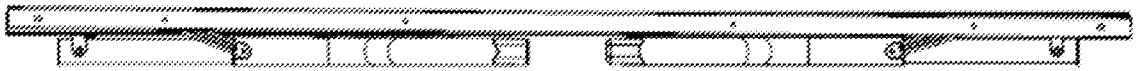
FIG. 3B is a side view illustrating the foldable frame of FIG. 1A in a folded state in accordance with exemplary embodiments of the present disclosure.

First linking assembly 140*a* is connected to the first bench frame at the first side of the foldable frame and second linking assembly 140*b* is connected to the first bench frame at the second side of the foldable frame. In some exemplary embodiments, the first linking assembly is pivotally connected to the first bench frame and the first bench leg of the first leg assembly is pivotally connected to the first linking assembly. The first bench leg of first leg assembly 130*a* is pivotally coupled with first linking assembly 140*a* and the first bench leg of second leg assembly 130*b* is pivotally coupled with second linking assembly 140*b*. As such, even though the first bench leg is shorter than the one or more table legs, each of the first and second leg assemblies is allowed to rotate as a single unit between a use position as illustrated in FIG. 1A and a storage position as illustrated in FIG. 3A. When in the use position, first bench frame 120-1 is positioned lower than the table frame because the first bench leg is shorter than the one or more table legs. As such, the first bench frame can be used to support a bench panel serving as a seating bench. When in the storage position, the table and bench frames are placed at a common plane with the first and second leg assemblies folded onto the common plane, resulting in a compact panel-like structure. As such, the foldable frame and table using the same are very convenient to carry around.

In some exemplary embodiments, when the first or second leg assembly is unfolded (e.g., in the use position), an upper end portion of the first bench leg abuts the first bench frame. When the first or second leg assembly is folded (e.g., in the storage position), the upper end portion of the first bench leg separates from the first bench frame. For instance, in some exemplary embodiments, first linking assembly 140*a* is pivotally connected to the first bench frame adjacent to first bench-lateral member 123 and second linking assembly 140*b* is pivotally connected to the first bench frame adjacent to second bench-lateral member 124. When first leg assembly 130*a* is unfolded, the upper end portion of first bench leg 133-1 abuts first bench-lateral member 123 of the first bench frame, thereby supporting the first bench frame as illustrated in FIG. 1A. When first leg assembly 130*a* is folded, the upper end portion of first bench leg 133-1 separates from first bench-lateral member 123 of the first bench frame as illustrated in FIG. 3A.

In some exemplary embodiments, each of the first and second linking assemblies is pivotally connected to at least one of the first and second bench-longitudinal members. For instance, in some exemplary embodiments, first linking assembly 140*a* includes a first linking member such as first linking member 141 and a second linking member such as second linking member 142. First linking member 141 has a first end portion pivotally connected to first bench-longitudinal member 121 adjacent to first bench-lateral member 123. Second linking member 141 has a first end portion pivotally connected to second bench-longitudinal member 122 adjacent to first bench-lateral member 123. First bench leg 133-1 of first leg assembly 130*a* is pivotally connected to second end portions of the first and second linking members of first linking assembly 140*a*. In some exemplary embodiments, each of the first and second linking assemblies includes a third linking member such as third linking member 143 disposed between the first and second linking member, and connected to or integrally formed with the first and second linking members. The third linking member enhances the strength of the first or second linking assembly and thus helps stabilize the first or second leg assembly when in use.

In some exemplary embodiments, an engaging member is disposed at the upper end portion of a bench leg to help stabilize the first or second leg assembly when it is in the use position and/or to help connect the bench leg with the first or second linking assembly. For instance, as an example, an engaging member such as engaging member 135 is disposed at the upper end portion of first bench leg 133-1 to help stabilize the first leg assembly when it is in the use position and/or to help connect the first bench leg with the first linking assembly. When the first leg assembly is unfolded, the engaging member abuts the first bench-lateral member. The engaging member can have any suitable shapes and sizes. Generally, it has a cross-section larger than the first bench leg, thereby increasing the contact area with the first bench-lateral member and thus stabilizing the first leg assembly when unfolded. In some exemplary embodiments, to further enhancing the stability, engaging member 135 includes one or more bended segments. For instance, in an exemplary embodiment, engaging member 135 includes a first segment such as first segment 135*a* and a second segment as second segment 135*b* bended with respect to the first segment. When the first leg assembly is unfolded, the first segment abuts a lower side of the first bench-lateral member to support the first bench frame, and the second segment abuts an interior side of the first bench-lateral member (e.g., the side facing the middle of the bench frame). As such, the second segment helps to prevent separation of the first bench leg from the first bench-lateral member or to help stabilize the first bench leg of the first leg assembly. While one bended segment is illustrated, it should be noted that engaging member 135 can include more than one bended segment. For instance, in an exemplary embodiment, engaging member 135 includes another bended segment at a side opposite to the second segment.

Similarly, in embodiments having two bench frames, the second bench legs of the first and second leg assemblies are connected to the second bench frame by linking assemblies, which can be the same as or different from the linking assemblies for connecting the first bench legs of the first and second leg assemblies to the first bench frame. When unfolded, second bench frame 120-2 is positioned lower than the table frame because the second bench leg is shorter than the one or more table legs. As such, the second bench frame can be used to support another bench panel serving as another seating bench. In an exemplary embodiment, the first and second bench legs have the same lengths and thus the first and second bench frames have the same height when in the use position. In another exemplary embodiment, the first and second bench legs have different lengths and thus the first and second bench frames have different heights when in the use position.

In some exemplary embodiments, the foldable frame of the present disclosure further includes one or more supporting assemblies to control rotation of the first and second leg assemblies, to stabilize the first and second leg assemblies when unfolded, to help support the table frame, or any combination thereof. For instance, in some exemplary embodiments, foldable frame 100 includes a first supporting assembly such as first supporting assembly 150*a* and a second supporting assembly such as second supporting assembly 150*b*. The first and second supporting assemblies can be the same as or different from each other.

In some exemplary embodiments, the first supporting assembly is pivotally connected to the first leg assembly and the second supporting assembly is pivotally connected with the second leg assembly. Each of the first and second leg assemblies is also pivotally connected to the table frame. For instance, in some exemplary embodiments, the first or second supporting assembly includes a first member such as first member 151 pivotally connected to the first or second leg assembly, e.g., table leg lateral bar 132 of the first or second leg assembly. The first or second supporting assembly also includes a controller such as controller 152 connected with the first member and selectively movable along the first member. In some exemplary embodiments, controller 152 is configured to be a slider or to include a slider similar to those disclosed in U.S. patent application Ser. No. 16/838,939, Ser. No. 16/838,944, Ser. No. 16/838,947, and Ser. No. 16/951,461, the disclosure of each application is incorporated herein for all purposes by reference in its entirety. In an exemplary embodiment, controller 152 includes a pin and an elastic member. The elastic member pushes the pin into a hole formed at the first member, thereby restricting the controller from moving along the first member. Pressing the elastic member will remove the pin from the hole at the first member, thereby allowing the controller to move along the first member. In some exemplary embodiments, a stopper is disposed at an end portion of the first member and configured to prevent complete disengagement of controller 152 from the first member.

The first or second supporting assembly further includes one or more additional members. For instance, in an exemplary embodiment, the first or second supporting assembly includes a second member such as second member 153 having a first end portion pivotally connected with the controller and a second end portion pivotally connected with the table frame, e.g., table-connecting member 115. In another exemplary embodiment, the first or second supporting assembly includes the second member and a third member such as third member 154. Like the second member, the third member has a first end portion pivotally connected with the controller and a second end portion pivotally connected with the connecting member of the mounting assembly. In an exemplary embodiment, the second and third members are disposed symmetrically with respect to each other, and the first, second and third members form a general "Y" shape. While the first and second supporting assemblies are shown connected to different table-connecting members, it should be noted that a table frame of the present disclosure can have one table-connecting member for connecting both the first and second supporting assemblies.

The first supporting assembly is configured to control the rotation of the first leg assembly and, when the foldable frame unfolded, to stabilize the first leg assembly and help support the table frame. Similarly, the second supporting assembly is configured to control the rotation of the second leg assembly and, when the foldable frame is unfolded, to stabilize the second leg assembly and help support the table frame. For instance, as the controller moves along the length direction of the first member, the second and third members move toward or away from the first member, resulting in shortening or lengthening the total length of the first or second supporting assembly. In the meantime, each of the first, second and third supporting members rotates. For instance, the first member rotates around the pivoting axis at which the first member is pivotally connected to the first or second leg assembly. The second member rotates around the pivoting axis at which the second member is pivotally connected to the controller, and rotates around the pivoting axis at which the second member is pivotally connected to the table-connecting member. The third member rotates around the pivoting axis at which the third member is pivotally connected to the controller, and rotates around the pivoting axis at which the third member is pivotally connected to the table-connecting member. As such, the first or second supporting assembly allows the first or second leg assembly to rotate between a use position as illustrated in FIG. 1A and a storage position as illustrated in FIG. 3A. When the first or second leg assembly is in the use position, the controller is restricted from moving along the first member (e.g., by a pin or the like), thereby preventing the first, second and third members from rotating and the total length of the supporting assembly from shortening or lengthening. As such, it prevents the leg assembly from accidental folding and thus helps stabilize the frame.

Referring now to FIGS. 4A-6, there is depicted exemplary foldable frame 400 in accordance with some exemplary embodiments of the present disclosure. Foldable frame 400 includes a table frame such as table frame 110 disclosed herein, and one or more bench frames such as first bench frame 420-1 and/or second bench frame 420-2. First bench frame 420-1 and second bench frame 420-2 can be but do not necessarily have to be identical or symmetrical with respect to each other. By way of example, first bench frame 420-1 and second bench frame 420-2 are illustrated to be substantially identical. In some exemplary embodiments, first bench frame 420-1 includes first and second bench-longitudinal members, such as first bench-longitudinal members 421 and second bench-longitudinal member 422. The first and second bench-longitudinal members are spaced apart in a first direction (e.g., x-direction in FIG. 4A). First bench frame 420-1 also includes a plurality of bench-lateral members such as first bench-lateral member 423, second bench-lateral member 424, third bench-lateral member 425 and/or fourth bench-lateral member 426. The bench-lateral members are spaced apart in a second direction (e.g., y-direction in FIG. 4A) and connected to the first and second bench-longitudinal members. In an exemplary embodiment, each of the bench-lateral member has an end portion connected to or integrally formed with the first bench-longitudinal member and another end portion connected to or integrally formed with the second bench-longitudinal member.

Foldable frame 400 also includes first and second leg assemblies such as first leg assembly 130*a* and second leg assembly 130*b* disclosed herein, of which each bench leg is connected to a bench frame in the one more bench frames by a linking assembly. For instance, in some exemplary embodiments, the first bench leg of first leg assembly 130*a* is connected to first bench frame 420-1 by first linking assembly 440*a* and the first bench leg of second leg assembly 130*b* is connected to first bench frame 420-1 by second linking assembly 440*b*. First linking assembly 440*a* and second linking assembly 440*b* can be but do not necessarily have to be identical or symmetrical with respect to each other. By way of example, first linking assembly 440*a* and second linking assembly 440*b* are illustrated to be substantially identical. The linking assemblies allow each of the first and second leg assemblies to rotate as one single unit even though the table and bench legs of the leg assembly are at different lengths and are connected to each other.

In some exemplary embodiments, similar to foldable frame 100, foldable frame 400 includes one or more supporting assemblies such as first supporting assembly 150*a* and/or second supporting assembly 150*b* disclosed herein to control rotation of the first and second leg assemblies, to stabilize the first and second leg assemblies when unfolded, to help support the table frame, or any combination thereof.

Figure 4A:
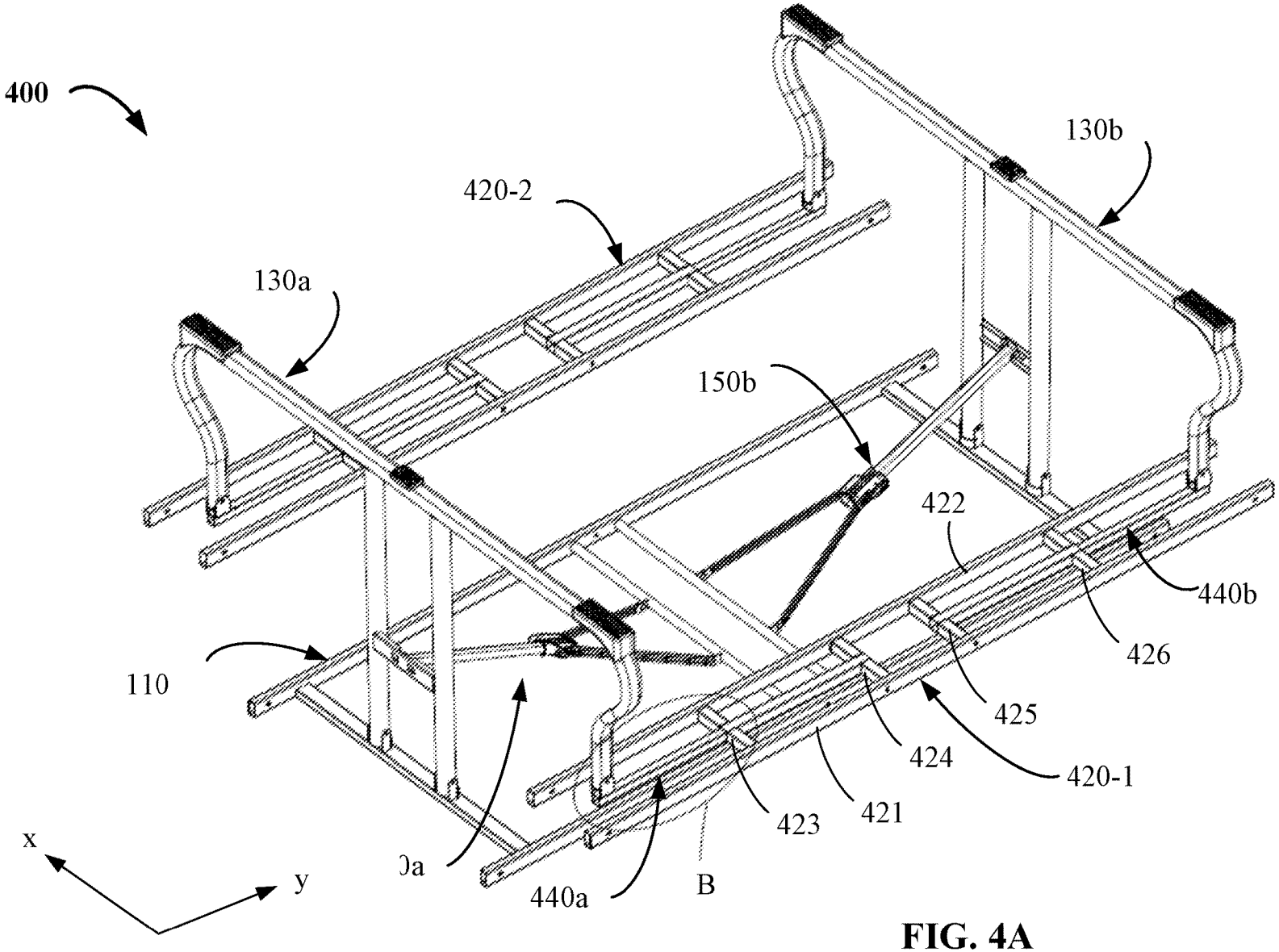
FIG. 4A is a bottom perspective view illustrating an exemplary foldable frame in an unfolded state in accordance with exemplary embodiments of the present disclosure.
Figure 4B:
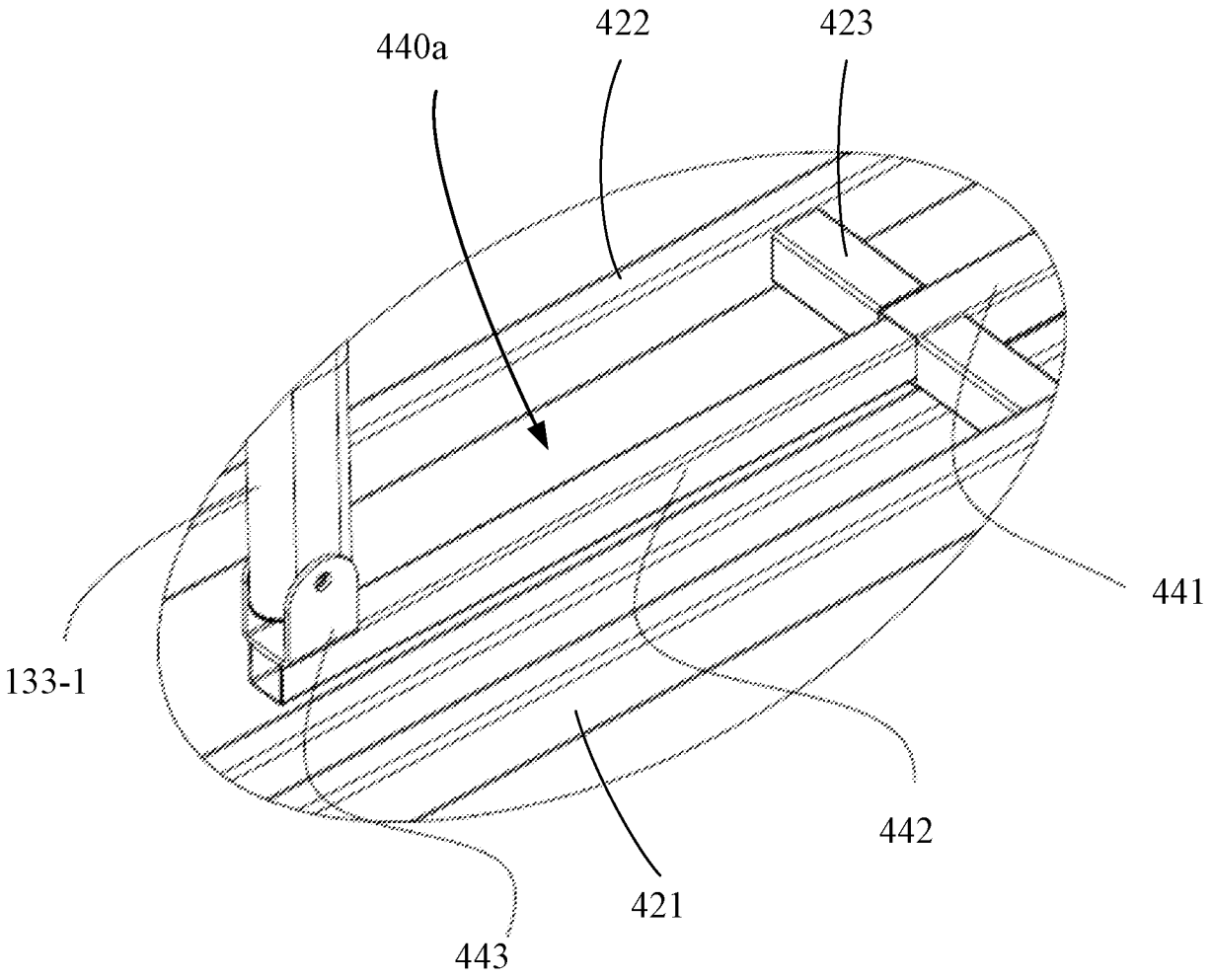
FIG. 4B is a partially enlarged view taken along circle B of FIG. 4A.
Figure 5:
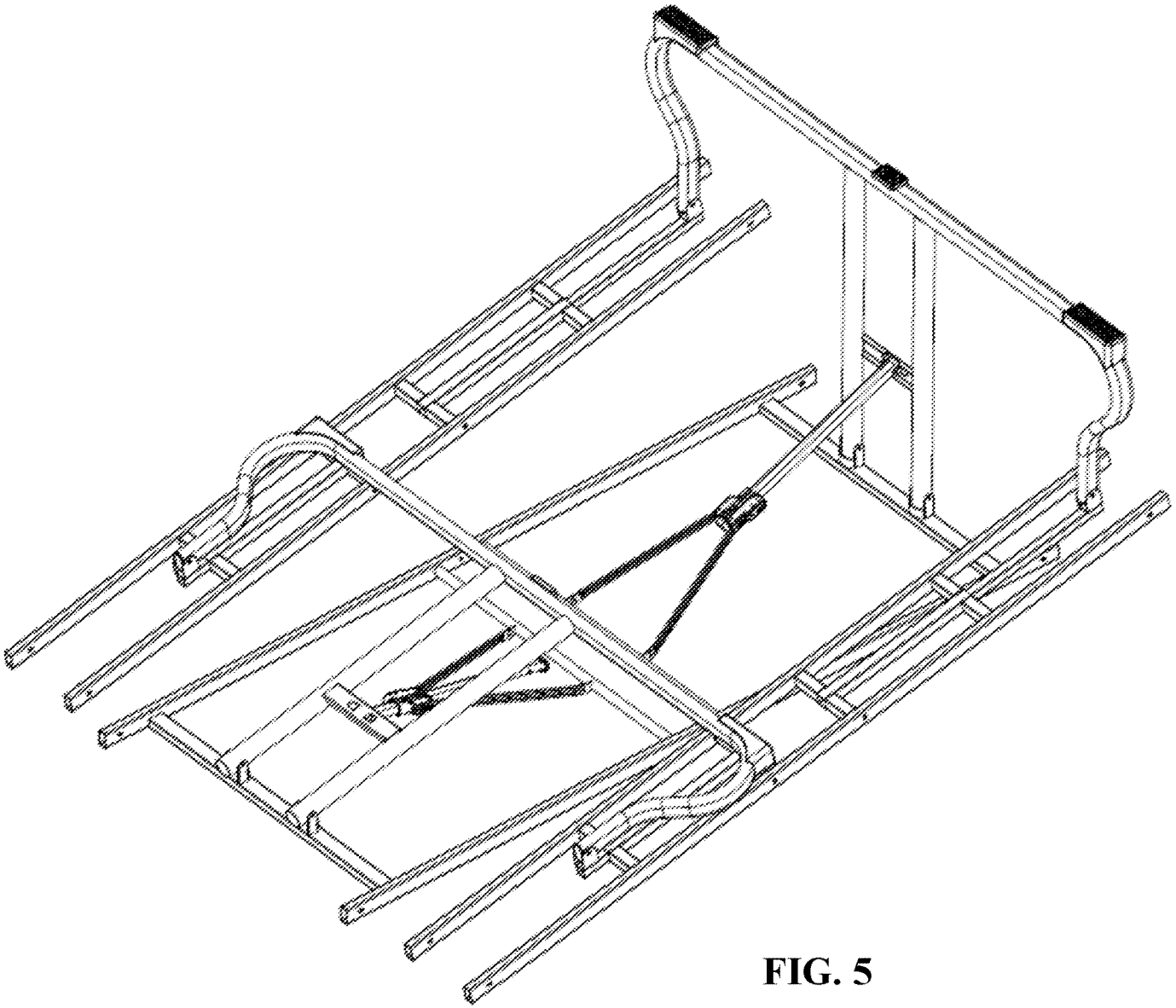
FIG. 5 is a bottom perspective view illustrating the foldable frame of FIG. 4A in an intermediate state in accordance with exemplary embodiments of the present disclosure.
Figure 6:
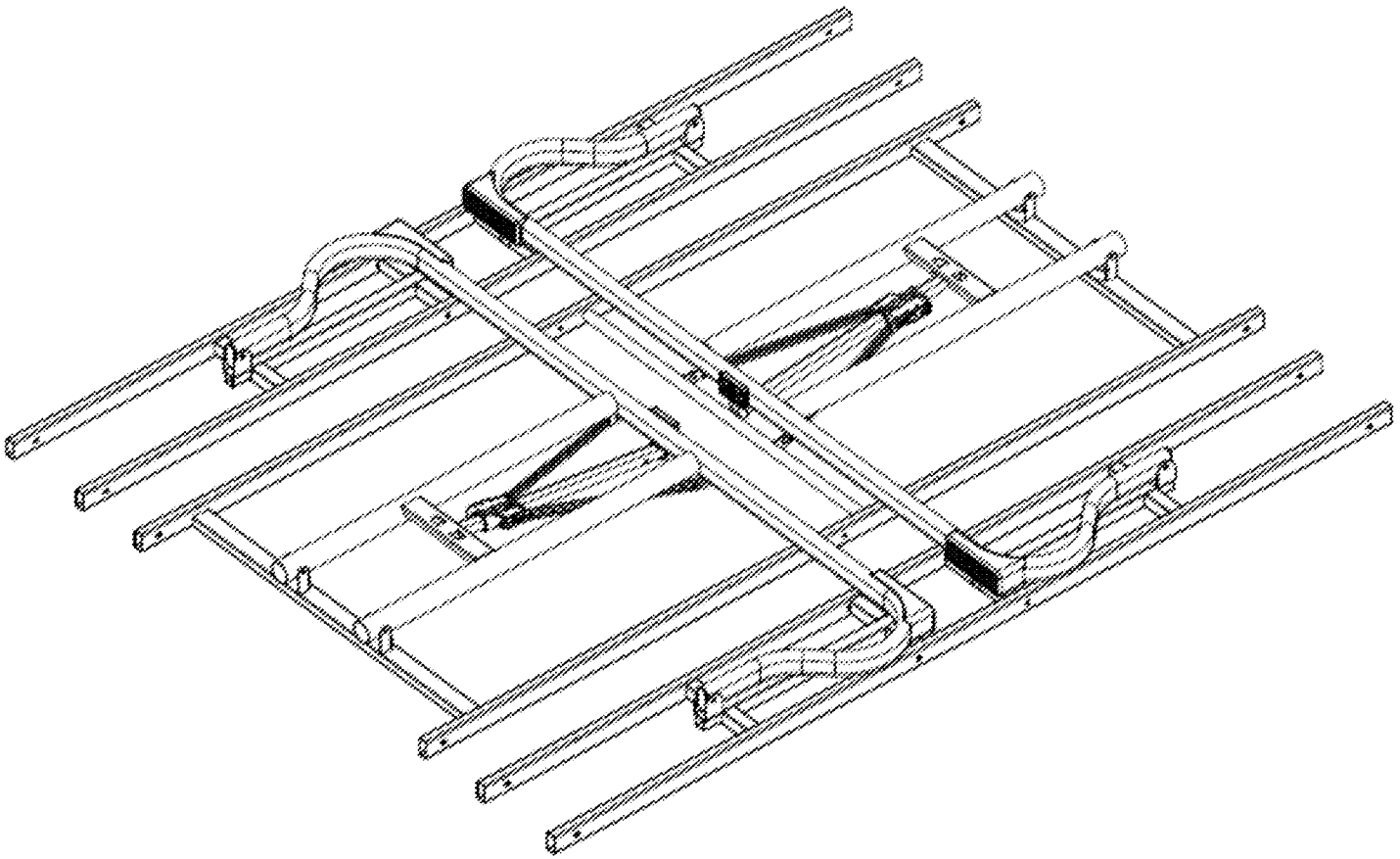
FIG. 6 is a bottom perspective view illustrating the foldable frame of FIG. 4A in a folded state in accordance with exemplary embodiments of the present disclosure.

Referring in particular to FIGS. 4A and 4B, in some exemplary embodiments, a linking assembly includes an adjustable bar having first and second bars telescopically coupled with each other. One of the first and second bars is coupled with a bench frame and the other of the first and second bars is coupled with a bench leg. For instance, in some exemplary embodiments, each of the first and second linking assemblies includes an adjustable bar having first bar 441 and second bar 442 telescopically coupled with each other. First bar 441 is fixedly coupled with one or more bench-lateral members. For instance, the first bar of first linking assembly 440*a* is fixedly coupled with first bench-lateral member 423 and/or second bench-lateral member 424. First bench leg 133-1 of the first leg assembly is pivotally connected to the second bar of first linking assembly 440*a*, for instance, by coupler 443. Coupler 443 can be a metal or plastic bracket or the like, and can be disposed at a distal end portion of the second bar. The first bar of second linking assembly 440*b* is fixedly coupled with third bench-lateral member 425 and/or fourth bench-lateral member 426. The first bench leg of the second leg assembly is pivotally coupled with the second bar of second linking assembly 440*b*. As such, even though the first bench leg and the one or more table legs are at different lengths and connected to each other, each of the first and second leg assemblies can rotate as one unit by moving the second bar with respect to the first bar.

In an exemplary embodiment, the first bar of first linking assembly 440*a* has an end portion fixedly coupled with first bench-lateral member 423 and another end portion fixedly coupled with second bench-lateral member 424. Similarly, in an exemplary embodiment, the first bar of second linking assembly 440*b* has an end portion fixedly coupled with third bench-lateral member 425 and another end portion fixedly coupled with fourth bench-lateral member 426.

Referring now to FIGS. 7A-9B, there is depicted exemplary foldable frame 700 in accordance with some exemplary embodiments of the present disclosure. Foldable frame 700 includes a table frame such as table frame 110 disclosed herein and one or more bench frames such as first bench frame 720-1 and/or second bench frame 720-2. First bench frame 720-1 and second bench frame 720-2 can be but do not necessarily have to be identical or symmetrical with respect to each other. By way of example, first bench frame 720-1 and second bench frame 720-2 are illustrated to be substantially identical. In some exemplary embodiments, first bench frame 720-1 includes first and second bench-longitudinal members, such as first bench-longitudinal members 721 and second bench-longitudinal member 722. The first and second bench-longitudinal members are spaced apart in a first direction (e.g., x-direction in FIG. 7A). Bench frame 720-1 also includes a plurality of bench-lateral members such as first bench-lateral member 723, second bench-lateral member 724, third bench-lateral member 725 and/or fourth bench-lateral member 726. The bench-lateral members are spaced apart in a second direction (e.g., y-direction in FIG. 7A) and connected to the first and second bench-longitudinal members. In an exemplary embodiment, each of the bench-lateral member has an end portion connected to or integrally formed with the first bench-longitudinal member and another end portion connected to or integrally formed with the second bench-longitudinal member.

Foldable frame 700 also includes first and second leg assemblies such as first leg assembly 130*a* and second leg assembly 130*b* disclosed herein. In some exemplary embodiments, a table leg of the first or second leg assembly is connected to the table-mounting members (e.g., mounting member 113 or 114) by coupler 116, which forms a tight or interference fit with the table leg when the first or second leg assembly is unfolded as illustrated in FIG. 7B. The tight or interference fit helps stabilize the first or second leg assembly when the foldable frame is in use.

Each bench leg of first and second leg assemblies is connected to a bench frame in the one more bench frames by a linking assembly. For instance, in some exemplary embodiments, the first bench leg of first leg assembly 130*a* is connected to first bench frame 720-1 by first linking assembly 740*a* and the first bench leg of second leg assembly 130*b* is connected to first bench frame 720-1 by second linking assembly 740*b*. First linking assembly 740*a* and second linking assembly 740*b* can be but do not necessarily have to be identical or symmetrical with respect to each other. By way of example, first linking assembly 740*a* and second linking assembly 740*b* are illustrated to be substantially identical. The linking assemblies allow each of the first and second leg assemblies to rotate as one single unit even though the table and bench legs of that leg assembly are at different lengths and are connected to each other.

In some exemplary embodiments, similar to foldable frame 100, foldable frame 700 includes one or more supporting assemblies such as first supporting assembly 150*a* and/or second supporting assembly 150*b* disclosed herein to control rotation of the first and second leg assemblies, to stabilize the first and second leg assemblies when unfolded, to help support the table frame, or any combination thereof.

Figure 7A:
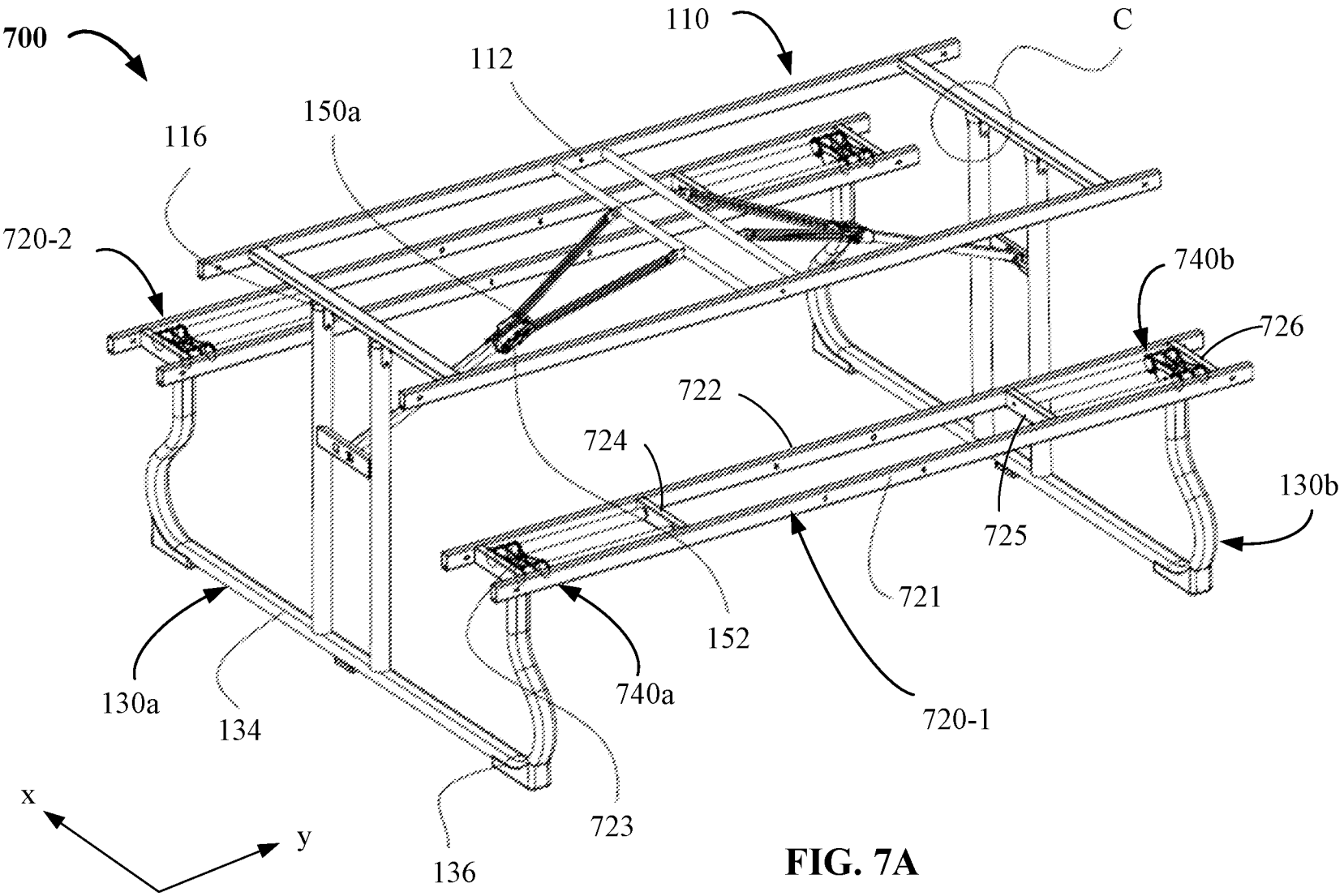
FIG. 7A is a perspective view illustrating an exemplary foldable frame in an unfolded state in accordance with exemplary embodiments of the present disclosure.
Figure 7B:
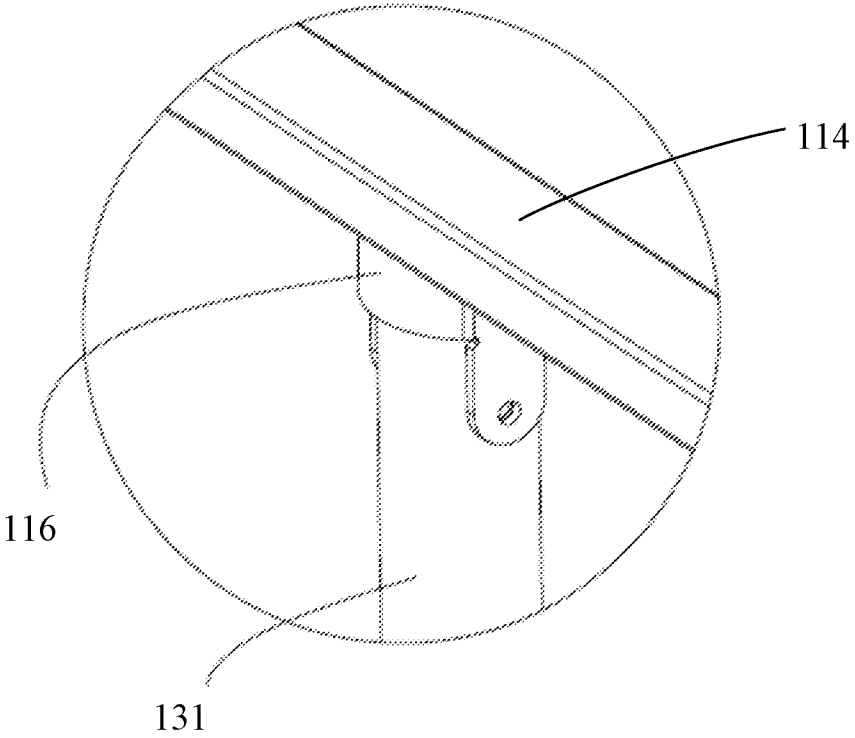
FIG. 7B is a partially enlarged view taken along circle C of FIG. 7A.
Figure 8:
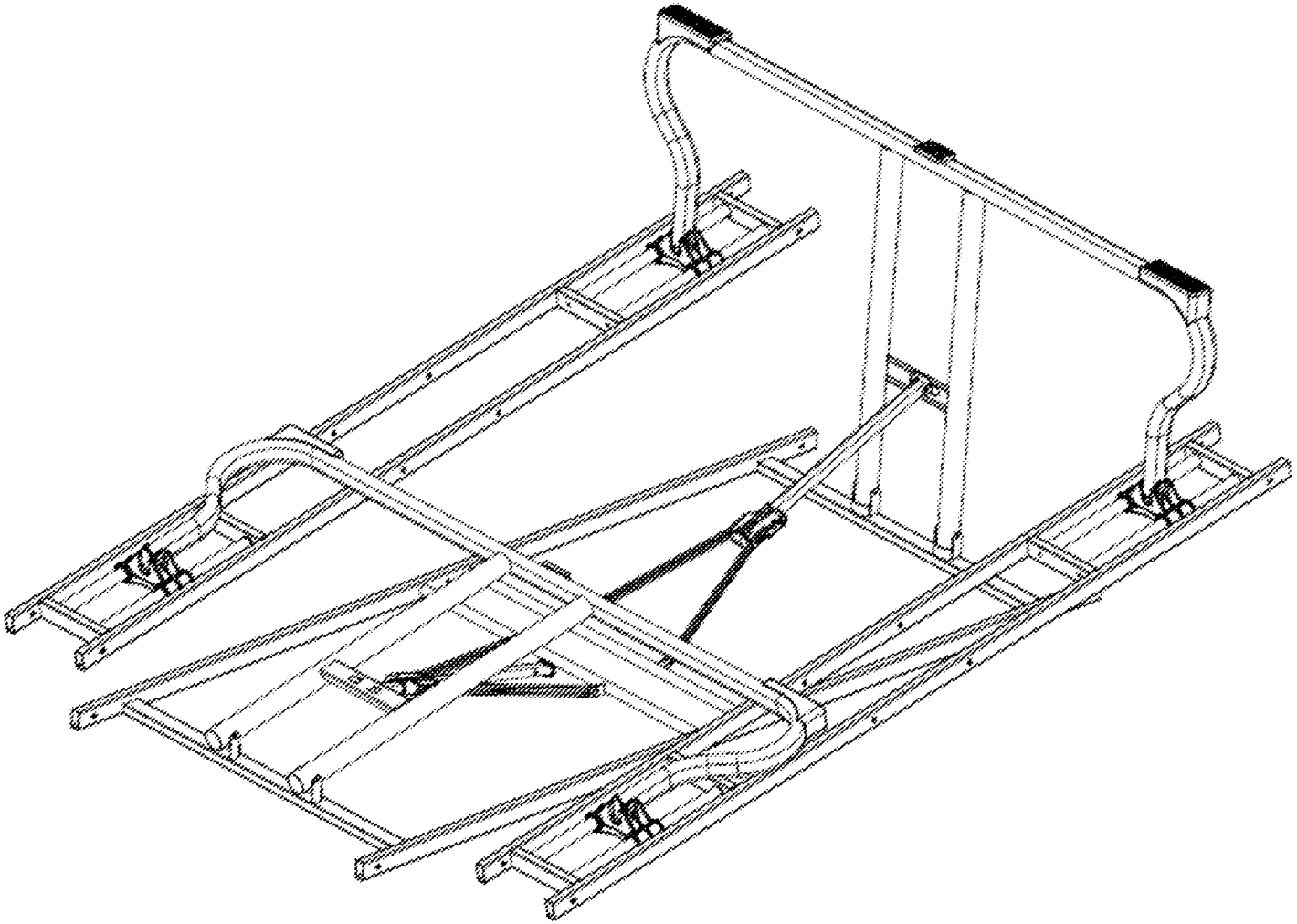
FIG. 8 is a bottom perspective view illustrating the foldable frame of FIG. 7A in an intermediate state in accordance with exemplary embodiments of the present disclosure.
Figure 9A:
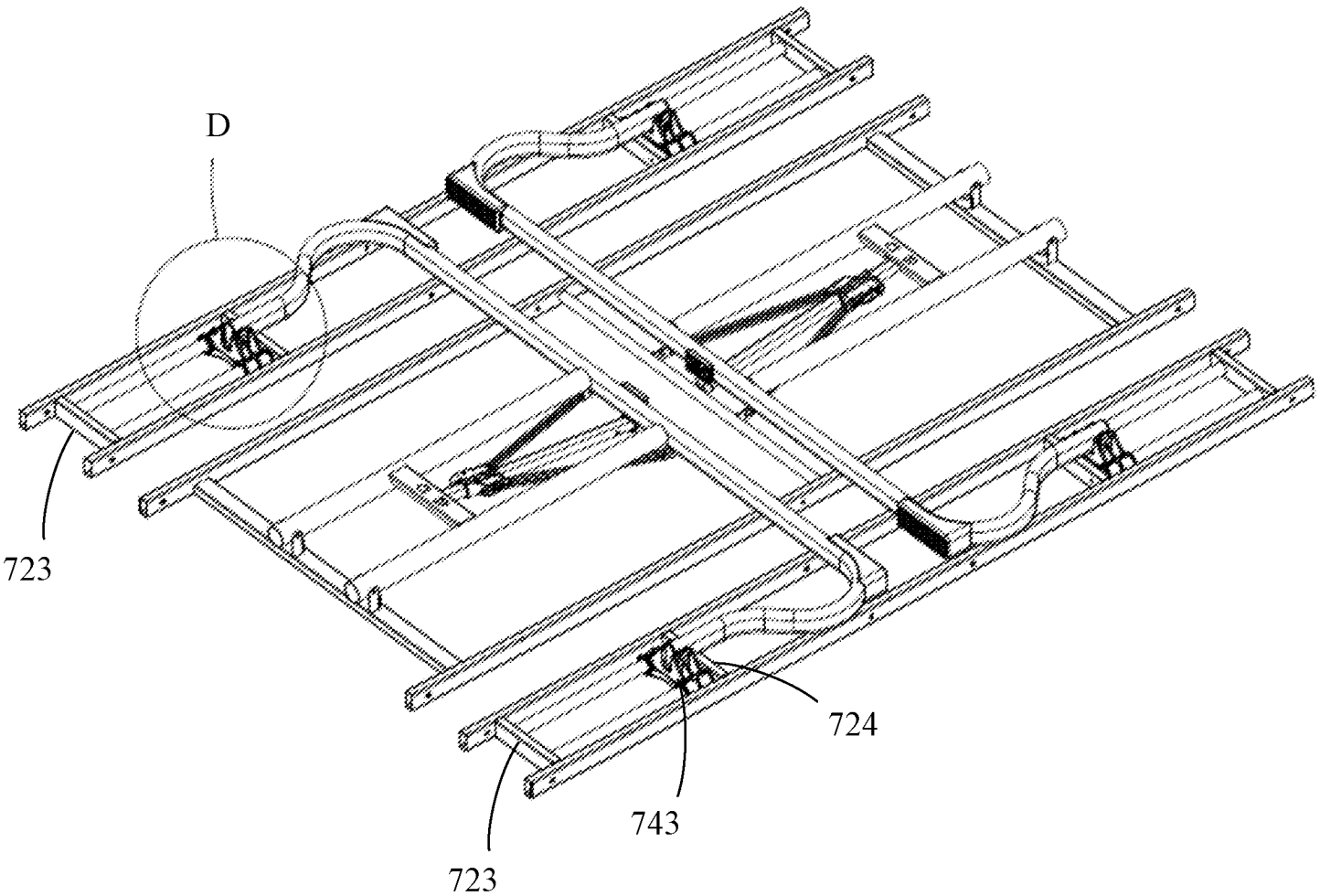
FIG. 9A is a bottom perspective view illustrating the foldable frame of FIG. 7A in a folded state in accordance with exemplary embodiments of the present disclosure.
Figure 9B:
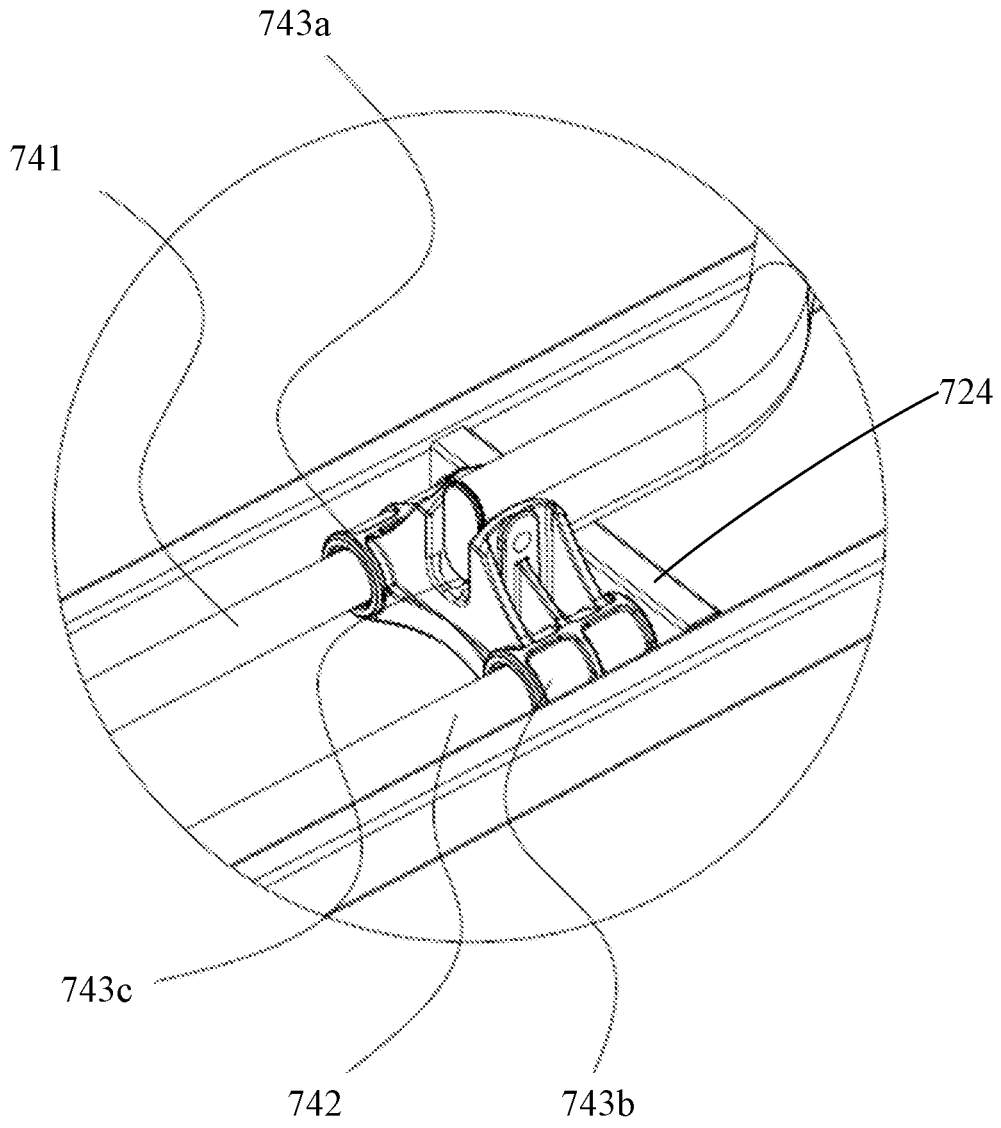
FIG. 9B is a partially enlarged view taken along circle D of FIG. 9A.

Referring in particular to FIGS. 7A, 9A and 9B, in some exemplary embodiments, a linking assembly includes one or more bars coupled with a bench frame. In an exemplary embodiment, a linking assembly includes a single bar. In another exemplary embodiment, a linking assembly includes two or more bars. By way of example, two bars such as first bar 741 and second bar 742 are illustrated. The first and second bars are substantially parallel to each other. In some exemplary embodiments, the first and second bars are coupled with one or more bench-lateral members of a bench frame. For instance, the first and second bars of first linking assembly 740*a* are coupled with first bench-lateral member 723 and second bench-lateral member 724, and the first and second bars of second linking assembly 740*b* are coupled with third bench-lateral member 725 and fourth bench-lateral member 726. In an exemplary embodiment, each of the first and second bars of first linking assembly 740*a* has an end portion fixedly coupled with first bench-lateral member 723 and another end portion fixedly coupled with second bench-lateral member 724. Similarly, each of the first and second bars of second linking assembly 740*b* has an end portion fixedly coupled with third bench-lateral member 725 and another end portion fixedly coupled with fourth bench-lateral member 726.

A slider is coupled with the one or more bars and movable along the one or more bars. In the illustrated embodiment, a slider such as slider 743 is coupled with first bar 741 and second bar 742 and movable along the first and second bars (e.g., movable along the length direction of the first and second bars). In some exemplary embodiments, slider 743 includes a first sleeve such as first sleeve 743*a* configured to sleeve on the first bar, a second sleeve such as second sleeve 743*b* configured to sleeve on the second bar and a slot such as slot 743*c* between the first and second sleeves in the second direction to receive and pivotally couple with an upper end portion of a bench leg (e.g., the first or second bench leg of the first or second leg assembly). In an exemplary embodiment, slider 743 is made, for instance, by injection molding or the like. As such, even though the first bench leg and the one or more table legs are at different lengths and connected to each other, each of the first and second leg assemblies can rotate as one unit by moving the slider along the one or more bars.

In some exemplary embodiments, the first and second bench-lateral members are positioned such that the slider of the first linking assembly contacts the first bench-lateral member when the first leg assembly is unfolded and contacts the second bench-lateral member when the first leg assembly is folded. Similarly, the third and fourth bench-lateral members are positioned such that the slider of the second linking assembly contacts the fourth bench-lateral member when the second leg assembly is unfolded and contacts the third bench-lateral member when the first leg assembly is folded.

Figure 10A:
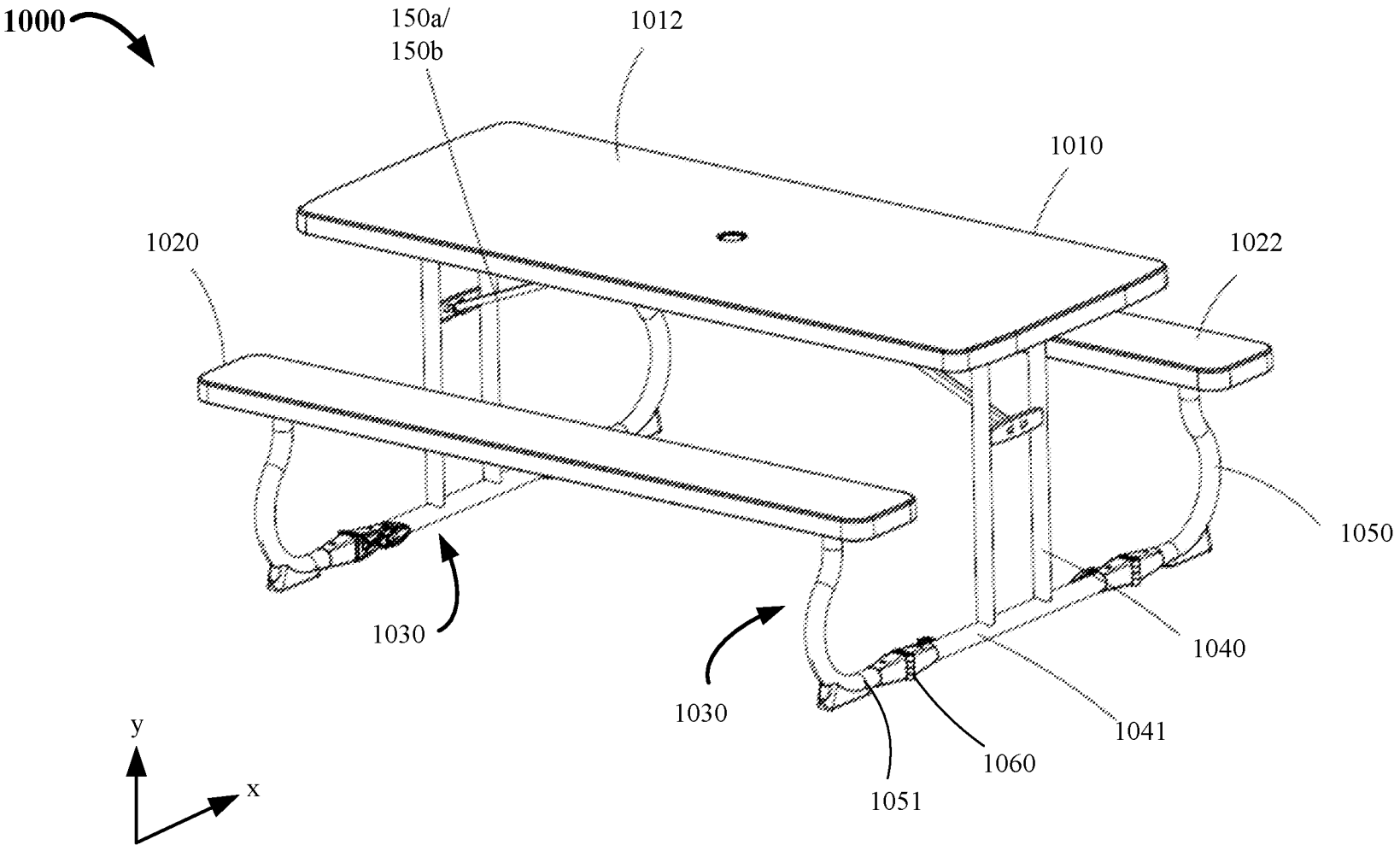
FIG. 10A is a top perspective view illustrating an exemplary picnic table in an unfolded state in accordance with exemplary embodiments of the present disclosure.
Figure 10B:
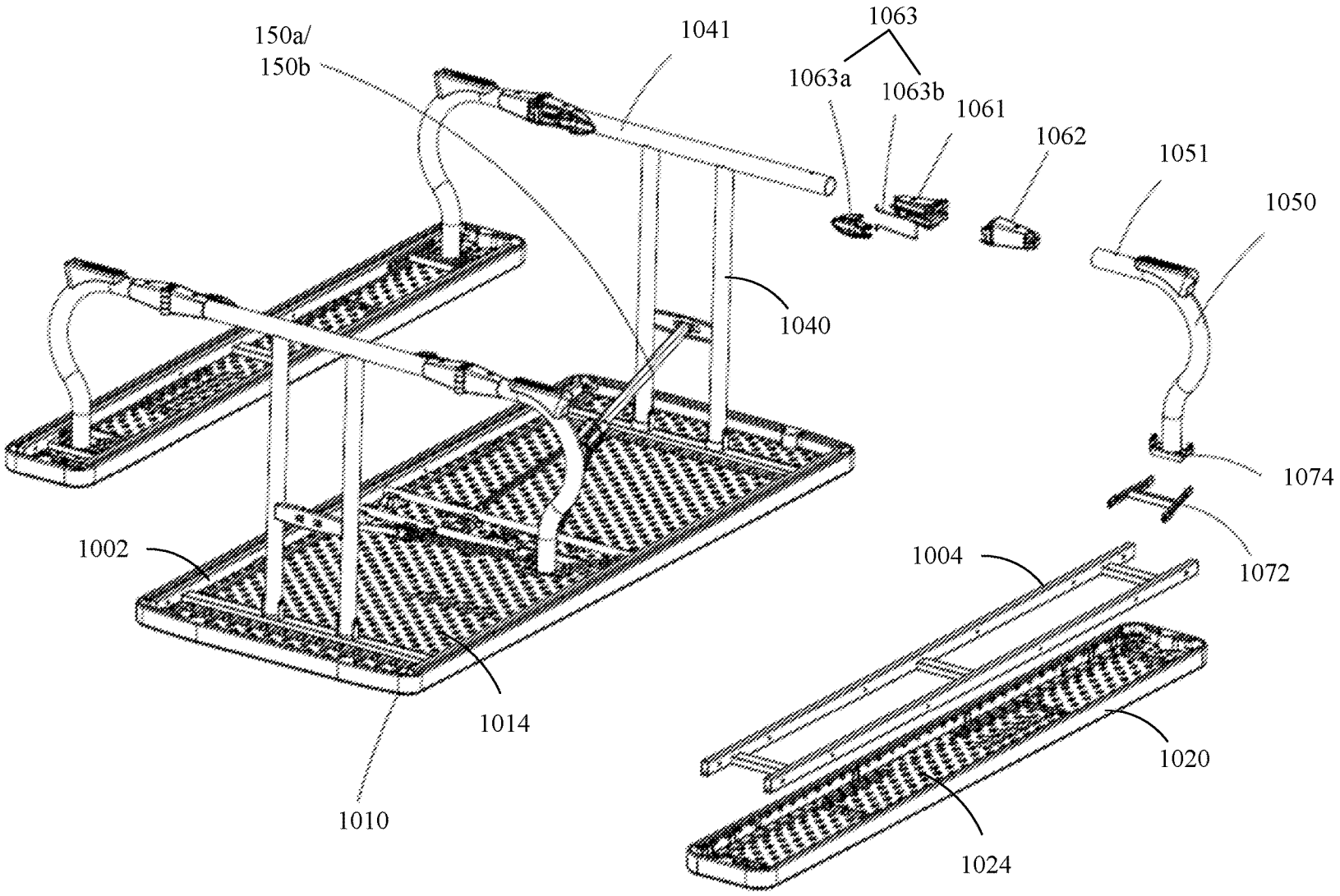
FIG. 10B is a partially disassembled perspective view illustrating the exemplary picnic table of FIG. 10A in accordance with exemplary embodiments of the present disclosure.

Referring now to FIGS. 10A-10B, there is depicted exemplary picnic table 1000 in accordance with some embodiments of the present disclosure. Picnic table 1000 includes a table panel such as table panel 1010 and one or more bench panels such as bench panel 1020. Table panel 1010 includes an upper side such as upper side 1012 and a lower side such as lower side 1014. Bench panel 1020 includes an upper side such as upper side 1022 and a lower side such as lower side 1024. Picnic table 1000 also includes a table frame such as table frame 1002 and one or more bench frames such as bench frame 1004. Table frame 1002 is disposed at a lower side of table panel 1010, and each bench frame 1004 is disposed at a lower side of a corresponding bench panel. Picnic table 1000 further includes one or more leg assemblies such as leg assembly 1030 to support the table and bench panels. Leg assembly 1030 includes a table support such as table support 1040 to support the table panel and one or more bench supports such as bench support 1050 to support the one or more bench panels. A table support generally includes one or more table legs and a bench support generally includes at least one bench leg.

In some exemplary embodiments, table support 1040 is rotatable with respect to table panel 1010 along a first direction (e.g., the x-direction in FIG. 10A or the lateral direction of the table panel). Similarly, bench support 1050 is rotatable with respect to bench panel 1020 along the first direction. For instance, referring to FIGS. 10B and 10D, in some exemplary embodiments, bench support 1050 is connected to bench panel 1020 through a bench frame such as bench frame 1004 and a bench link such as bench link 1072. Bench link 1072 has a first end portion pivotally connected with bench frame 1004 and a second end portion pivotally connected with an upper end portion of the bench support. In an exemplary embodiment, bench link 1072 is connected with the bench support through additional or optional connecting piece such as connecting piece 1074 disposed at the upper end portion of the bench support. In an exemplary embodiment, connecting piece 1074 is configured substantially the same as or similar to engaging member 135. With bench link 1072, the bench and table supports of the first or second leg assembly can rotate together along the first direction even when they are at different lengths or heights.

While bench frame 1004 and bench link 1072 are illustrated to be substantially the same as bench frame 120-1 and linking assembly 140*a*, it should be noted that they can be configured to be substantially the same as or similar to any bench frame and linking assembly disclosed herein. For instance, in an exemplary embodiment, they are configured to be substantially the same as or similar to bench frame 420-1 and linking assembly 440*a*, or bench frame 720-1 and linking assembly 740*a*. In such cases, bench support 1050 is connected to bench panel 1020 through bench frame 420-1 and linking assembly 440*a*, or through bench frame 720-1 and linking assembly 740*a*.

In some exemplary embodiments, the table and bench panels of leg assembly 1030 are connected with each other and rotatable with respect to each other along a second direction (e.g., the y-direction in FIG. 10A) that is different than the first direction. In an exemplary embodiment, the second direction is substantially perpendicular to the first direction. For instance, in some exemplary embodiments, leg assembly 1030 includes one or more connectors such as connector 1060, each for pivotally connecting one bench support 1050 with table support 1040 such that the bench support is rotatable with respect to the table support in the second direction. As such, picnic table 1000 is foldable multiple times.

Figure 10C:
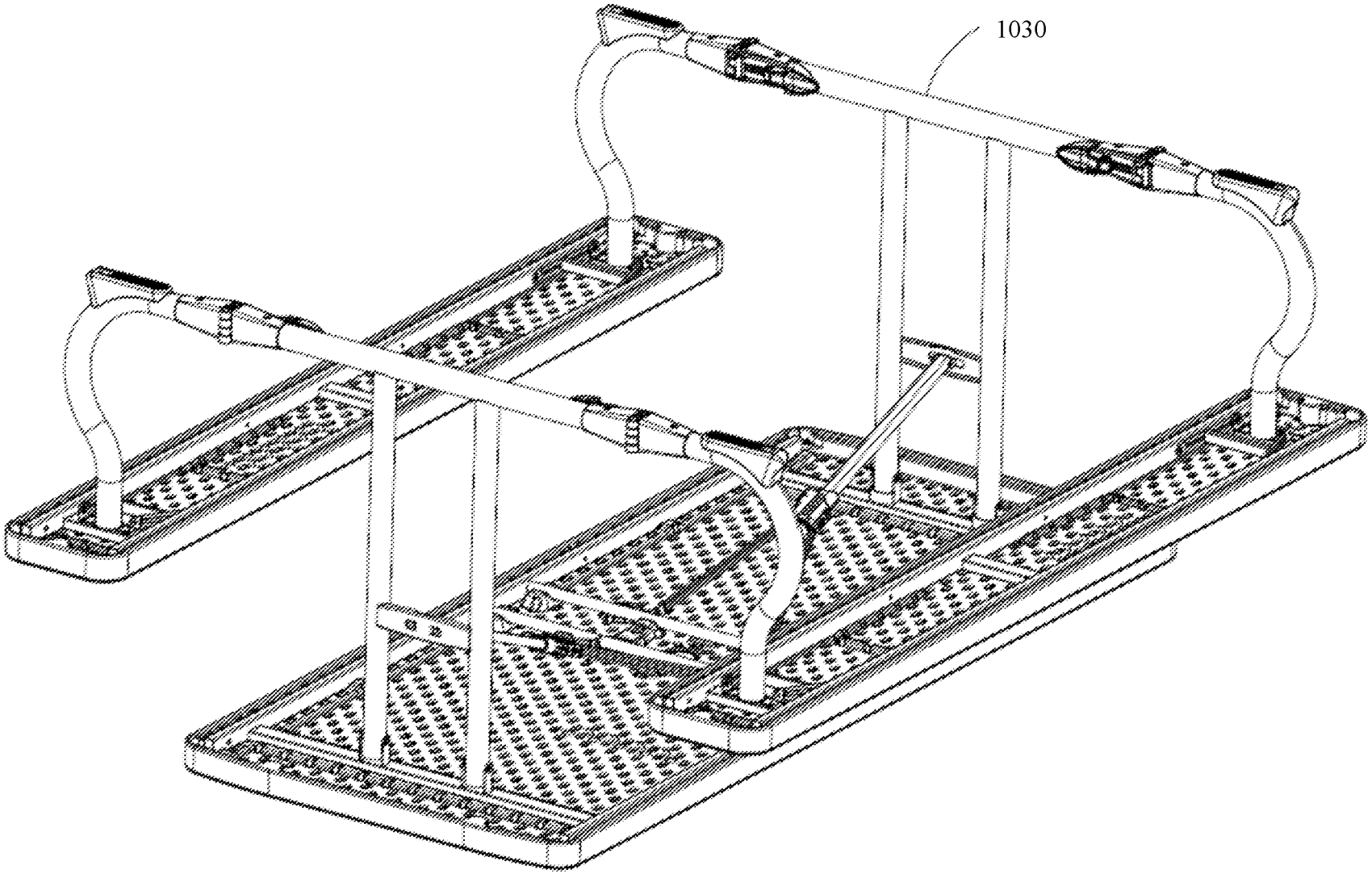
FIG. 10C is a bottom perspective view illustrating the exemplary picnic table of FIG. 10A.
Figure 10D:
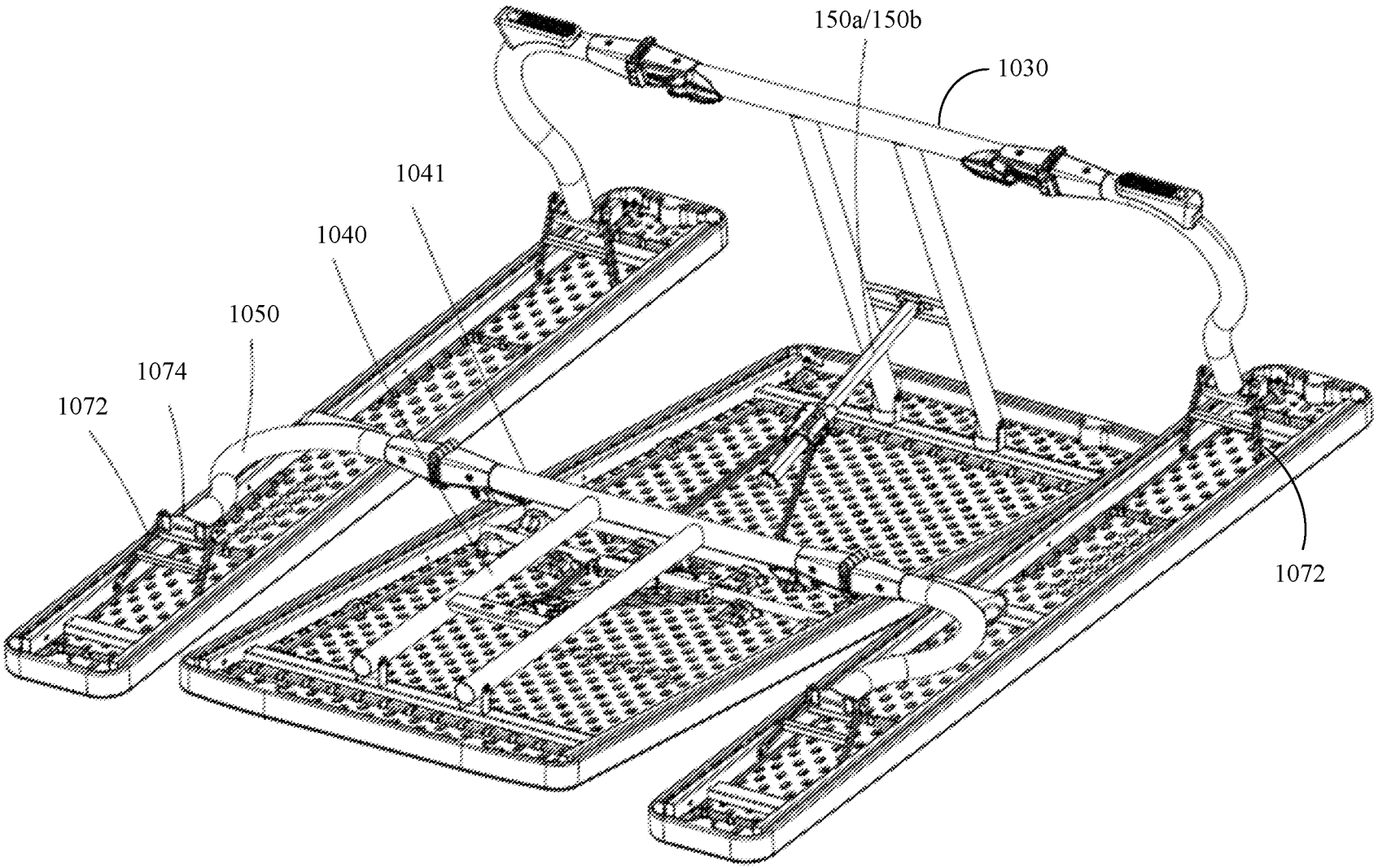
FIG. 10D is a bottom perspective view illustrating the exemplary picnic table of FIG. 10A in a first intermediate state in accordance with exemplary embodiments of the present disclosure.
Figure 10E:
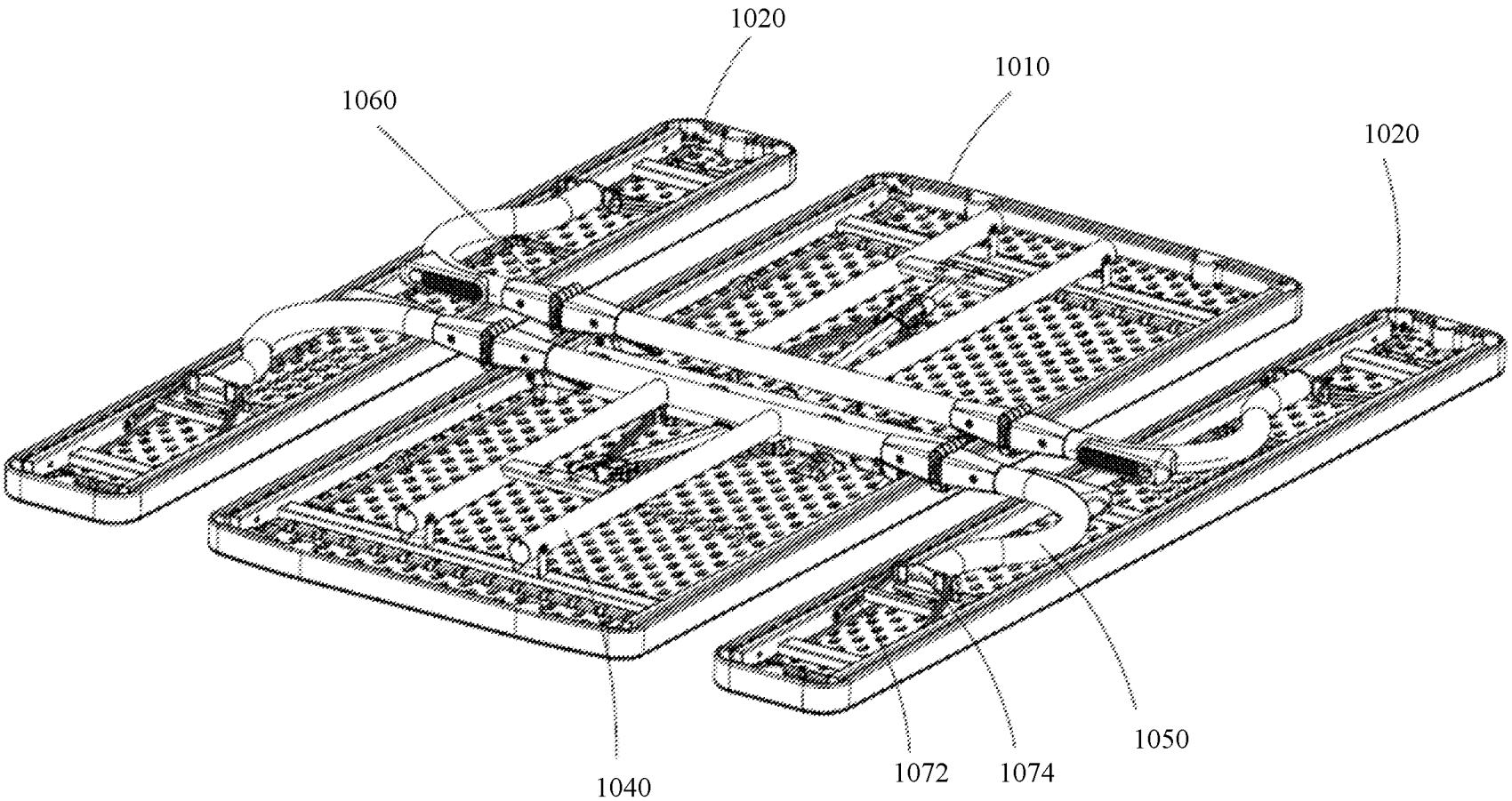
FIG. 10E is a bottom perspective view illustrating the exemplary picnic table of FIG. 10A in a second intermediate state in accordance with exemplary embodiments of the present disclosure.
Figure 10F:
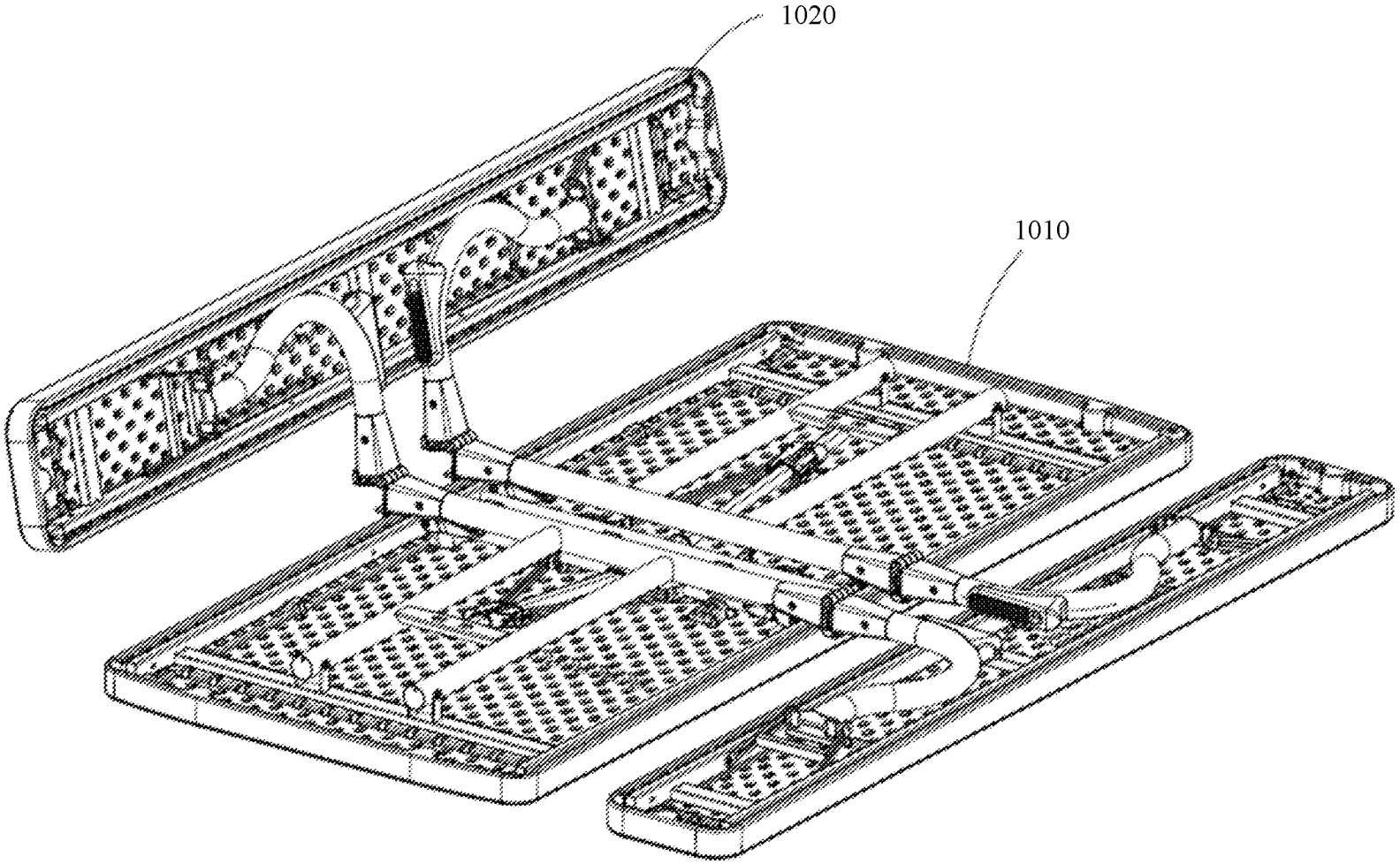
FIG. 10F is a bottom perspective view illustrating the exemplary picnic table of FIG. 10A in a third intermediate state in accordance with exemplary embodiments of the present disclosure.
Figure 10G:
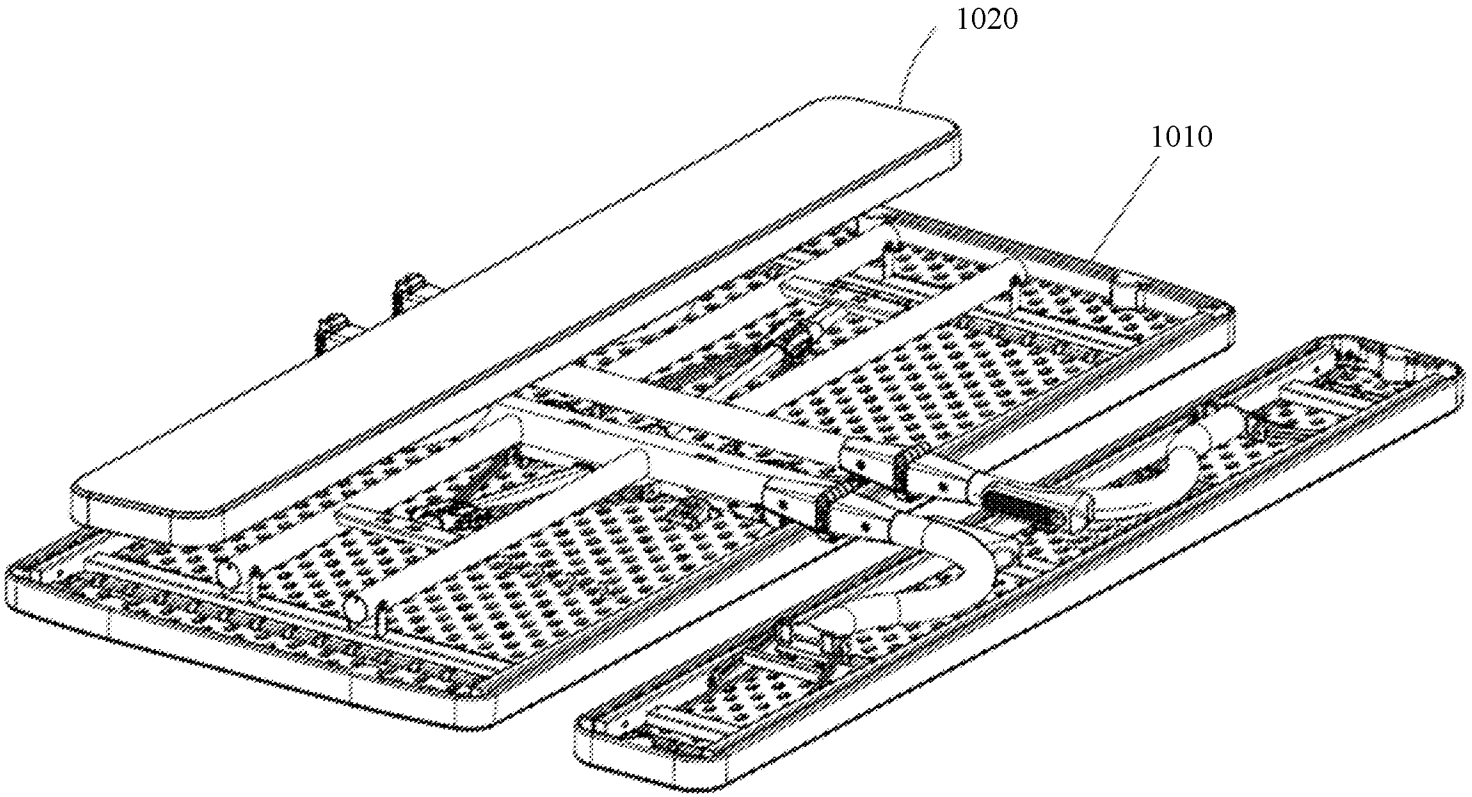
FIG. 10G is a bottom perspective view illustrating the exemplary picnic table of FIG. 10A in a fourth intermediate state in accordance with exemplary embodiments of the present disclosure.
Figure 10H:
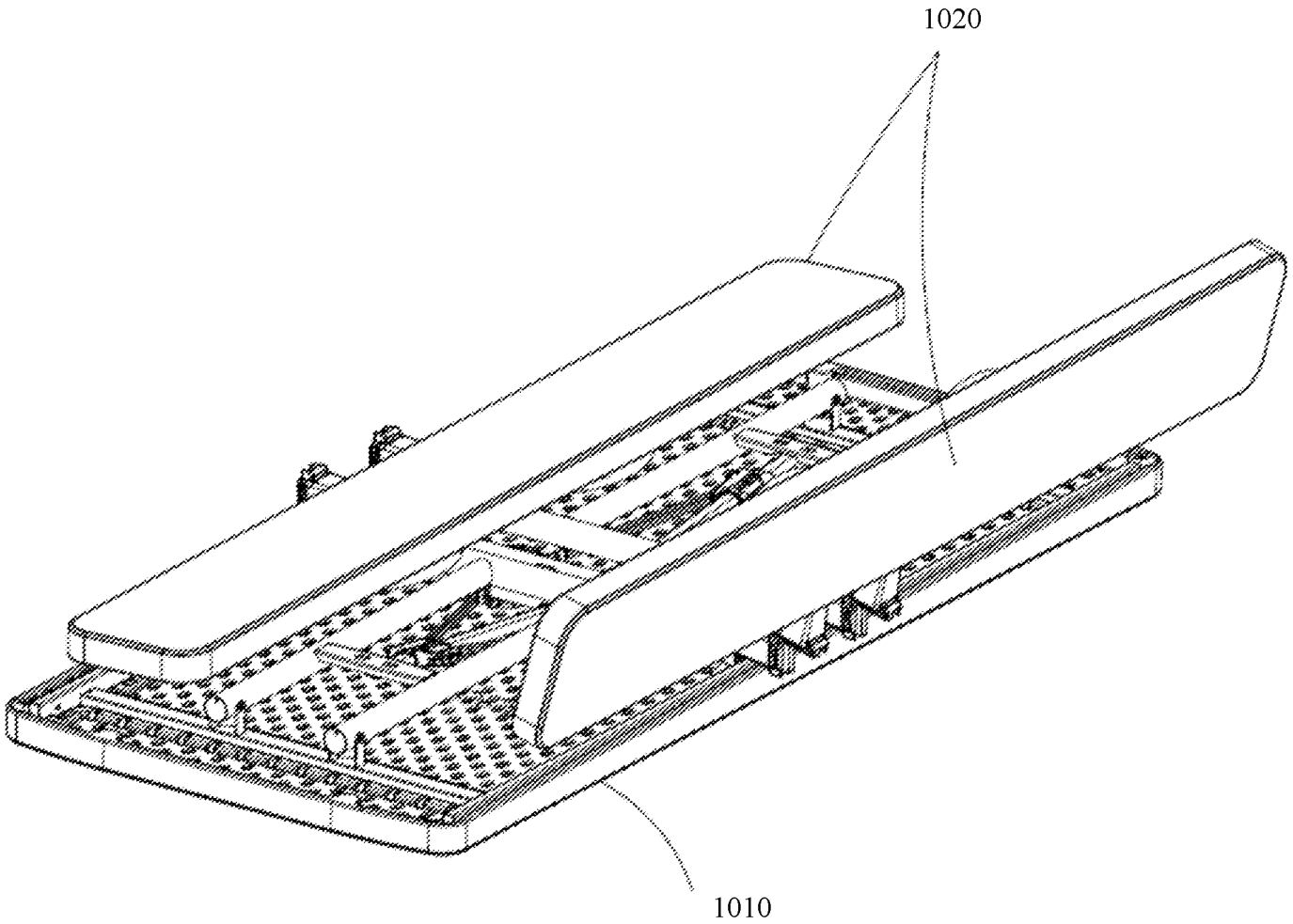
FIG. 10H is a bottom perspective view illustrating the exemplary picnic table of FIG. 10A in a fifth intermediate state in accordance with exemplary embodiments of the present disclosure.
Figure 10I:
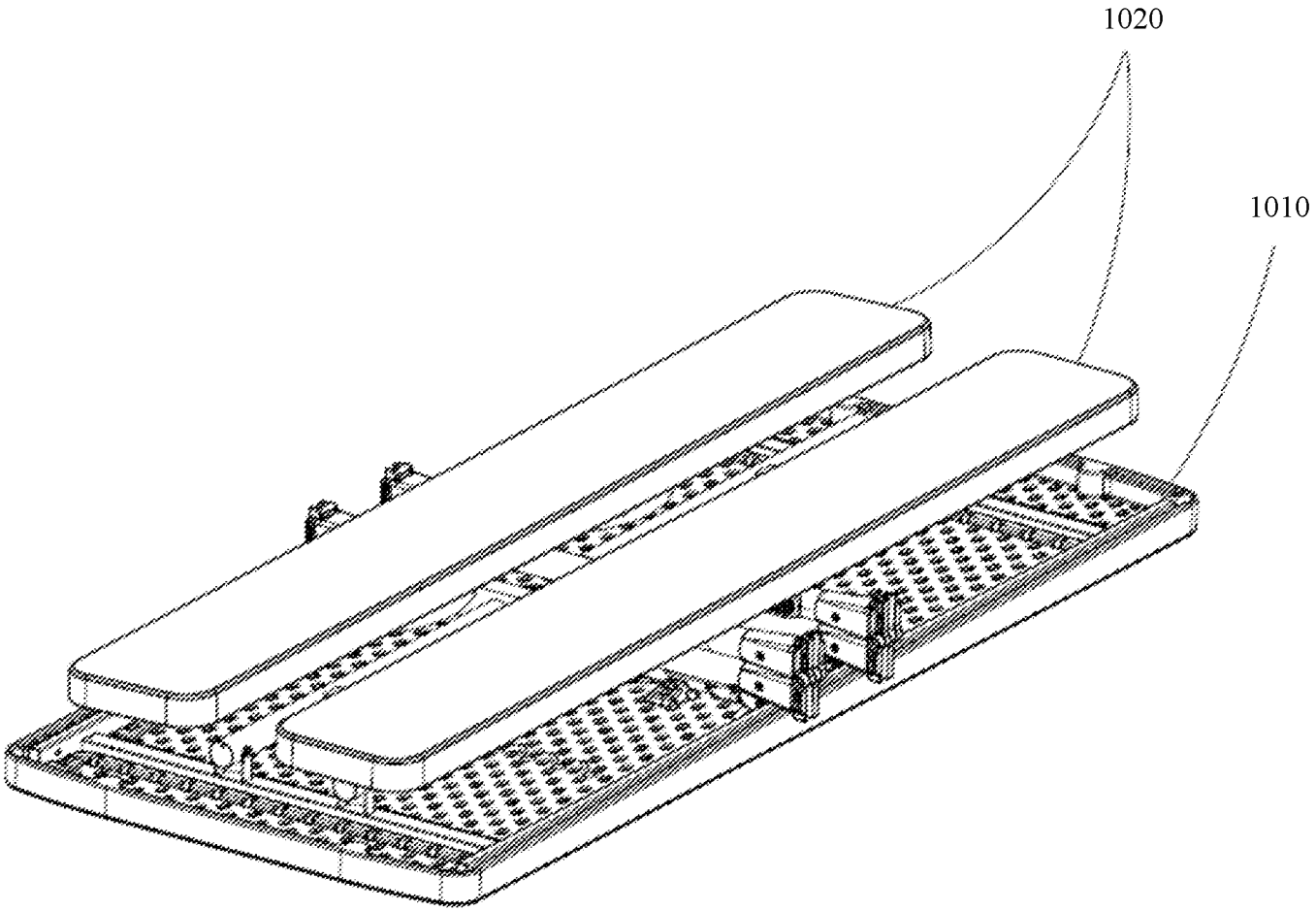
FIG. 10I is a bottom perspective view illustrating the exemplary picnic table of FIG. 10A in a folded state in accordance with exemplary embodiments of the present disclosure.

Referring to FIGS. 10C-10I, there is depicted an exemplary process for folding and unfolding picnic table 1000. With the presence of bench link 1072, there is no need to level the table and bench panels to fold the picnic table. Each leg assembly can rotate along the first direction and fold onto the table and bench panels when they are at different lengths or height. This process is illustrated in FIGS. 10C-10E. After each leg assembly is folded to the table and bench panels, each bench panel is rotated and folded onto the table panel as illustrated in FIGS. 10F-10I. The folded picnic table is illustrated in FIG. 10I. The leg assemblies (at least a portion of them) are sandwiched between the table and bench panels. While rotation illustrated in FIGS. 10F-10I results in the lower sides of the table and bench panels facing each other (e.g., back-to-back), it should be noted that a similar structure can be constructed such that when folded the upper sides of the table and bench panels face each other (e.g., face-to-face). In either case, the picnic table is folded into a generally layered block-like structure. As such, when folded, it is compact, and thus easy and convenient for storage and transportation. Reversing the process unfolds the picnic table.

In some exemplary embodiments, table support 1040 includes a first supporting bar such as first supporting bar 1041 and bench support 1050 includes a second supporting bar such as second supporting bar 1051. First supporting bar 1041 and second supporting bar 1051 are aligned with each other in the first direction when unfolded (e.g., when bench panel 1020 is unfolded from table panel 1010, or when the picnic table is unfolded). Connector 1060 pivotally connects the second supporting bar of the bench support with the first supporting bar of the table support such that the second supporting bar is rotatable with respect to the first supporting bar of the table support in the second direction.

Figure 11A:
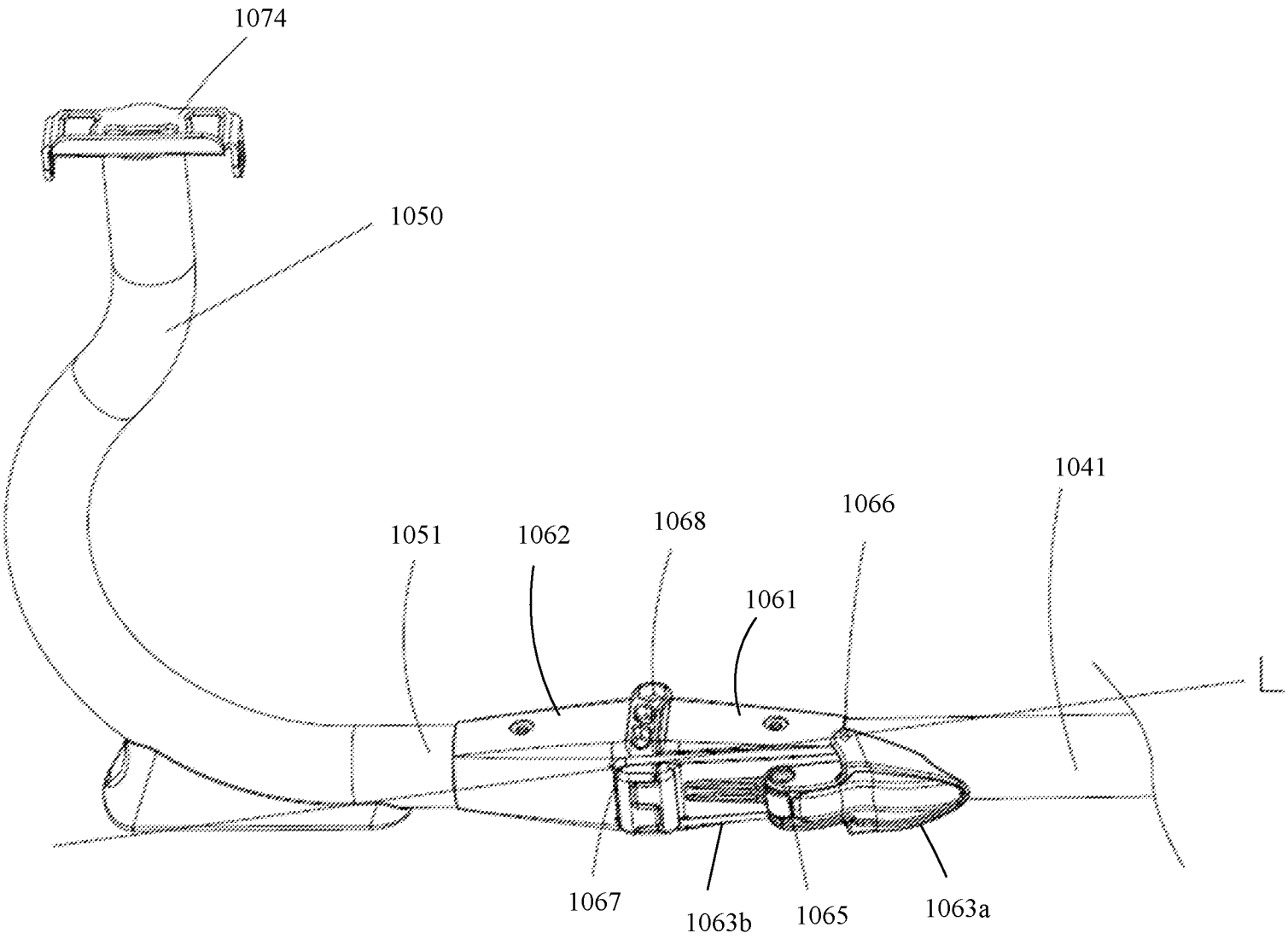
FIG. 11A is a perspective view illustrating a connection in an exemplary supporting assembly in a first state in accordance with exemplary embodiments of the present disclosure.
Figure 11B:
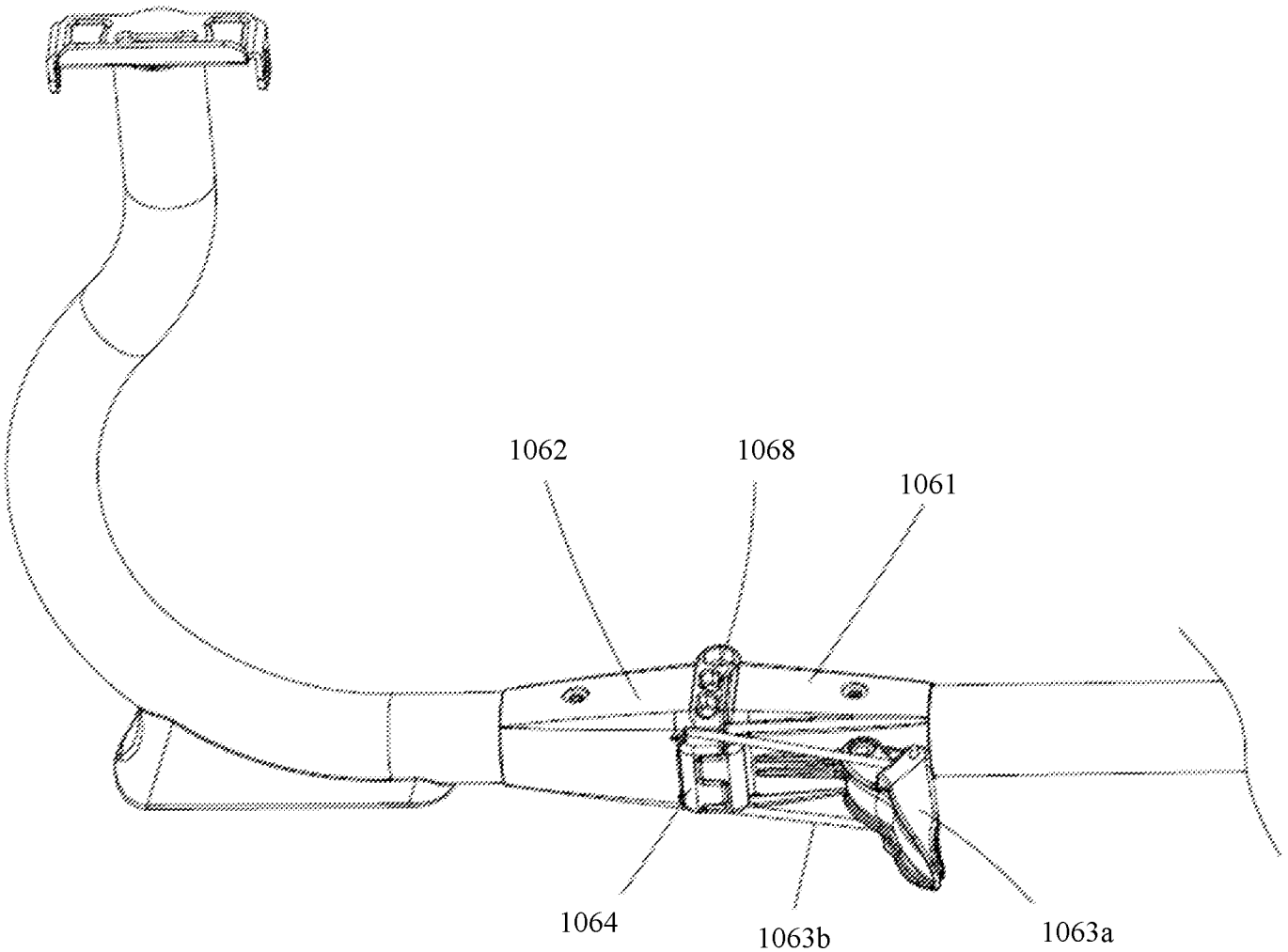
FIG. 11B is a perspective view illustrating a connection in an exemplary supporting assembly in a second state in accordance with exemplary embodiments of the present disclosure.
Figure 11C:
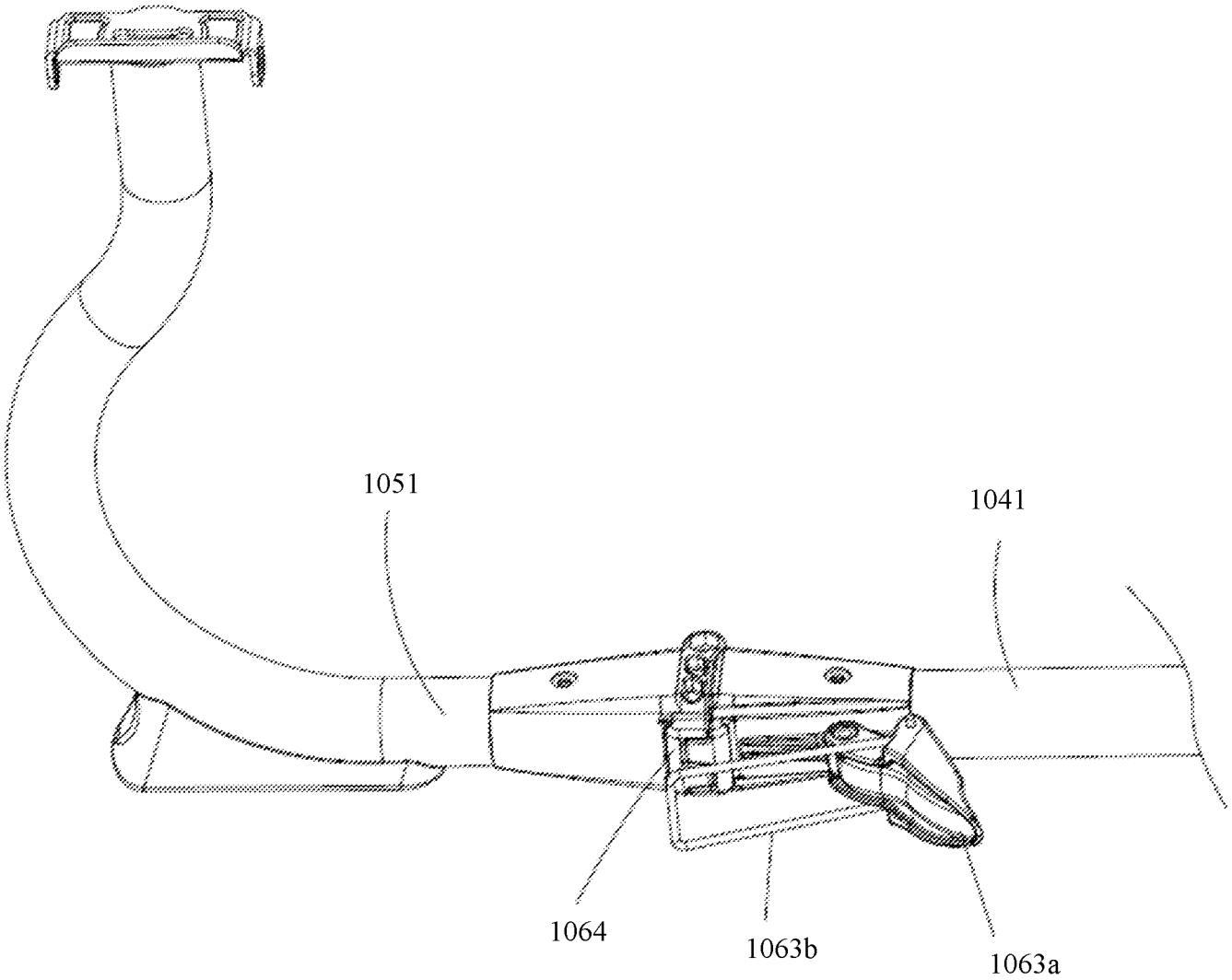
FIG. 11C is a perspective view illustrating a connection in an exemplary supporting assembly in a third state in accordance with exemplary embodiments of the present disclosure.
Figure 11D:
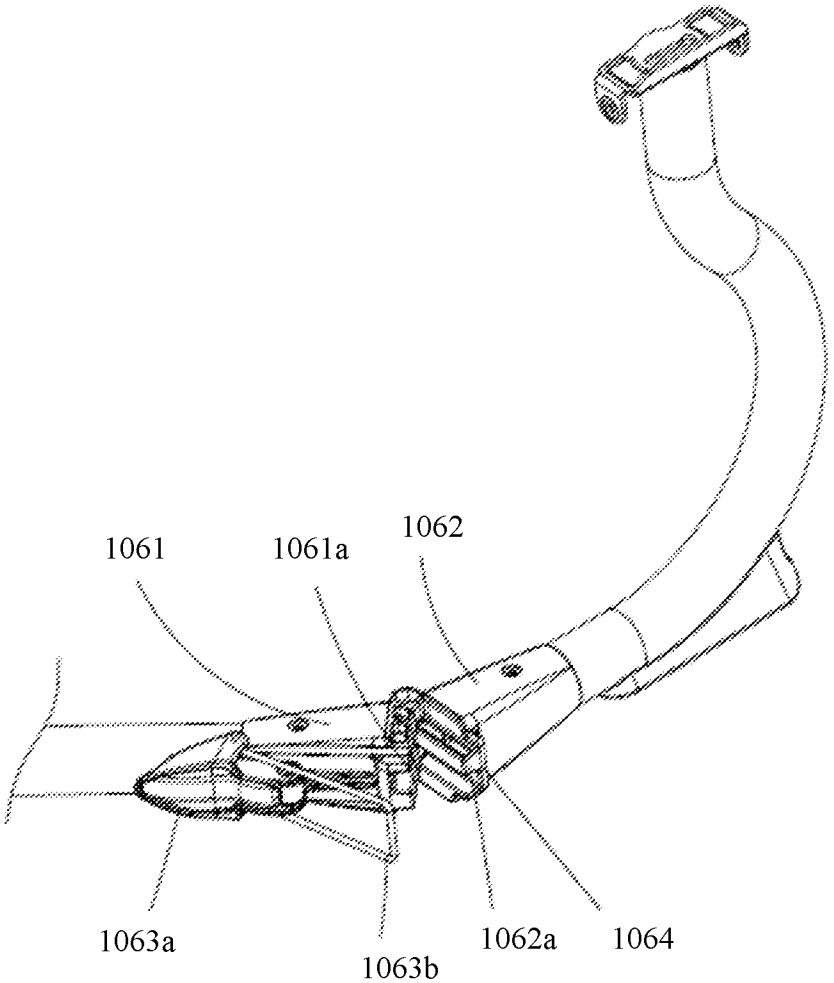
FIG. 11D is a perspective view illustrating a connection in an exemplary supporting assembly in a fourth state in accordance with exemplary embodiments of the present disclosure.
Figure 11E:
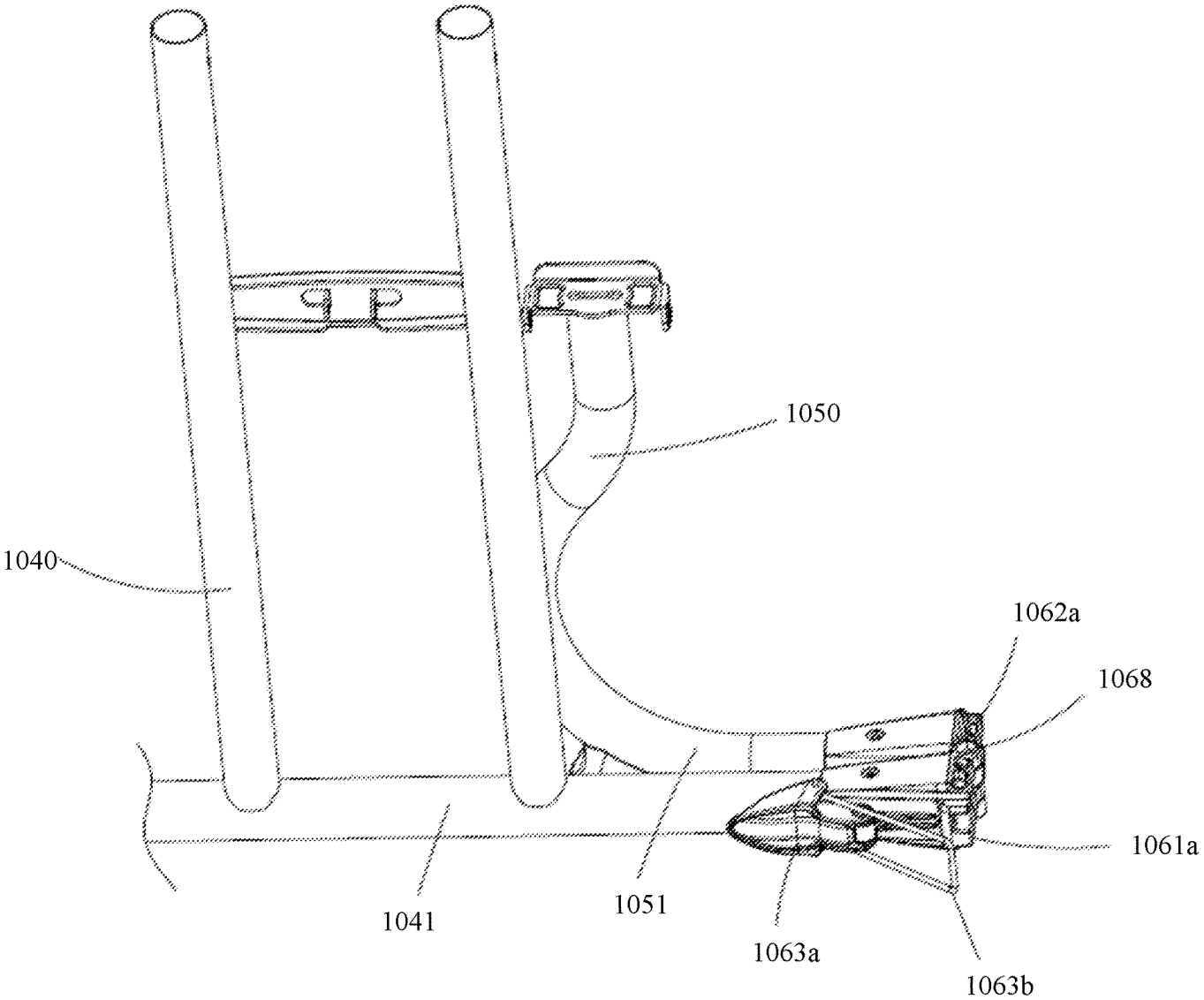
FIG. 11E is a perspective view illustrating a connection in an exemplary supporting assembly in a fifth state in accordance with exemplary embodiments of the present disclosure.

Referring to FIGS. 10B and 11A-11E, there are depicted connector 1060 and the use of the connector to connect the second supporting bar of the bench support with the first supporting bar of the table support in accordance with some exemplary embodiments of the present disclosure. Of these figures, FIG. 11A illustrates the connection at an unfolded (e.g., the first and second supporting bars are aligned with each other) and locked state, FIGS. 11B and 11C illustrate the connection at the unfolded but unlocked state, FIG. 11D illustrates the connection at an intermediate state, and FIG. 11E illustrates the connection at a folded state. It should be noted that other connectors and relevant components can be used to make picnic tables foldable multiple times. Examples of such connectors and picnic tables are disclosed in U.S. patent application Ser. No. 17/069,458, the disclosure of the application is incorporated herein for all purposes by reference in its entirety.

In some exemplary embodiments, connector 1060 includes a plurality of couplers configured to connect the first supporting bar with the second supporting bar and lock the first and second supporting bars in position when unfolded. For instance, in some exemplary embodiments, connector 1060 includes a first coupler such as first coupler 1061, a second coupler such as second coupler 1062 and a third coupler such as third coupler 1063. The first coupler is connected with an end portion of one of the first and second supporting bars and the second coupler connected with an end portion of the other one of the first and second supporting bars. By way of example, FIGS. 11A-11E illustrate first coupler 1061 connected with first supporting bar 1041 and second coupler 1062 connected with second supporting bar 1051. The first and second couplers are pivotally connected with each other, e.g., pivotal axis 1068, thereby allowing the first and second supporting bars to rotate with respect to each other along the second direction.

Connector 1060 also includes a third coupler such as third coupler 1063 pivotally connected with one of the first and second couplers and removably connected with the other of the first and second couplers. By way of example, FIGS. 11A-11E illustrate third coupler 1063 pivotally connected with first coupler 1061 and removably connected with second coupler 1062. When connected with the second coupler, the third coupler locks the first and second couplers and restricts the first and second couplers from rotating with respect to each other. Accordingly, the first and second supporting bars are restricted from rotating with respect to each other at this state, resulting in a more stable picnic table.

In some exemplary embodiments, the second coupler includes a protrusion such as protrusion 1064 at a side of the second coupler. The third coupler includes a first coupling piece such as first coupling piece 1063*a* and a second coupling piece 1063*b*. First coupling piece 1063*a* is pivotally connected with the first coupler at a first position such as first position 1065. Second coupling piece 1063*b* is pivotally connected with first coupling piece 1063*a* at a second position such as second position 1066 and removably connected with protrusion 1064 of the second coupler at a third position such as third position 1067. In an exemplary embodiment, second coupling piece 1063*b* includes a hook or buckle. In some exemplary embodiments, when unfolded and locked, the first position is located between the second and third positions along a length direction of the first supporting bar and is offset from a line defined by the second and third positions. Such an arrangement of the first, second and third positions ensures the first and second couplers remaining at the locked state once the second coupling piece is engaged with the protrusion of the second coupler.

To engage the second coupling piece with the protrusion of the second coupler, the first coupling piece is rotated toward the second coupler and then the first coupling piece is hooked with the protrusion of the second coupler. After that, the first coupling piece is rotated toward the first coupler. Because the first position is located between the second and third positions along a length direction of the first supporting bar and is offset from a line defined by the second and third positions, the first and second coupling pieces will remain in place and thus lock the first and second couplers unless an external force is applied to rotate the first coupling piece. This ensures the structural stability of the bench and table supports and the structural stability of the picnic table. To fold the picnic table, the first coupling piece is rotated toward the second coupler and the second coupling piece is unbuckled from the protrusion. The first and second couplers, and accordingly the first and second supporting bars, are then allowed to rotate with respect to each other.

In some exemplary embodiments, each of the first and second couplers includes one or more ribs at the ends that face each other when unfolded to help further stabilize the table and/or bench supports. For instance, in an exemplary embodiment, first coupler 1061 includes one or more first ribs 1061*a* and second coupler 1062 includes one or more second ribs 1062*a*. First ribs 1061*a* and second ribs 1062*a* are zigzagged with respect to each other and operably coupled with each other when unfolded. First ribs 1061*a* and second ribs 1062*a* can have any suitable configurations including but not limited to straight, curved or circular ribs.

It should be noted that the components disclosed herein are combinable in any useful number and combination. As an example, first bench frame 120-1 can replace first bench frame 420-1 or 720-1. As another example, first linking assembly 140*a* can replace first linking assembly 440*a* or 740*a*.

The linking assemblies, supporting assemblies, foldable frames and picnic tables of the present disclosure have several advantages. For instance, the linking assemblies allows each of the first and second leg assemblies to rotate between a use position and a storage position as a single unit even though the table and bench legs are at different lengths. This significantly simplifies the folding and unfolding processes, making the foldable frames of the present disclosure very easy to use. Moreover, the linking assemblies allow the table and bench frames to be placed at different heights when the first and second leg assemblies are unfolded. Further, the linking assemblies allow the table and bench frames to be placed at a common plane with the first and second leg assemblies folded onto the common plane. As a result, when folded, the foldable frame (and thus a picnic table using the foldable frame) becomes a compact panel-like structure and accordingly is very convenient for transportation and storage. Furthermore, in some cases, the leg assemblies are configured such that the picnic table using the foldable frame can be folded multiple times into a generally layered block-like structure, with each bench panel is laid on the table panel either face-to-face or back-to-back with the table panel. As such, the foldable frame and picnic table when folded are compact, portable and easy to carry around. In addition, the supporting assemblies and other additional/optional structures help stabilize and support the leg assemblies when unfolded and thus enhance the stability of the foldable frames (and the picnic tables using the foldable frames) when in use.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first bar could be termed a second bar, and, similarly, a second bar could be termed a first bar, without changing the meaning of the description, so long as all occurrences of the "first bar" are renamed consistently and all occurrences of the "second bar" are renamed consistently.

What is claimed is:

1. A foldable frame comprising:

a table frame;

a first bench frame;

first and second linking assemblies, the first linking assembly connected to the first bench frame at a first side of the foldable frame and the second linking assembly connected to the first bench frame at a second side of the foldable frame; and first and second leg assemblies, each comprising one or more table legs, a first bench leg, and a leg-linking member connecting the first bench leg with the one or more table legs, the first bench leg having a length shorter than the one or more table legs, wherein:

the one or more table legs of the first leg assembly are pivotally coupled with the table frame at the first side of the foldable frame;

the first bench leg of the first leg assembly is pivotally coupled with the first linking assembly;

the one or more table legs of the second leg assembly are pivotally coupled with the table frame at the second side of the foldable frame; and the first bench leg of the second leg assembly is pivotally coupled with the second linking assembly;

wherein:

the first linking assembly allows the first leg assembly to rotate as one unit and the second linking assembly allows the second leg assembly to rotate as another one unit, and when the first and second leg assemblies are unfolded, the first bench frame is positioned lower than the table frame;

the first linking assembly is pivotally connected to the first bench frame at the first side of the foldable frame and the first bench leg of the first leg assembly is pivotally connected to the first linking assembly such that an upper end portion of the first bench leg of the first leg assembly abuts the first bench frame when the first leg assembly is unfolded and separates from the first bench frame when the first leg assembly is folded;

the second linking assembly is pivotally connected to the first bench frame at the second side of the foldable frame and the first bench leg of the second leg assembly is pivotally connected to the second linking assembly such that an upper end portion of the first bench leg of the second leg assembly abuts the first bench frame when the second leg assembly is unfolded and separates from the first bench frame when the second leg assembly is folded;

the first bench frame comprises a first bench-lateral member at the first side of the foldable frame and a second bench-lateral member at the second side of the foldable frame;

the first linking assembly is pivotally connected to the first bench frame adjacent to the first bench-lateral member such that the upper end portion of the first bench leg of the first leg assembly abuts first bench-lateral member of the first bench frame when the first leg assembly is unfolded and separates from the first bench-lateral member of the first bench frame when the first leg assembly is folded; and the second linking assembly is pivotally connected to the first bench frame adjacent to the second bench-lateral member such that the upper end portion of the first bench leg of the second leg assembly abuts the second bench-lateral member of the first bench frame when the second leg assembly is unfolded and separates from the second bench-lateral member of the first bench frame when the second leg assembly is folded.

2. The foldable frame of claim 1, wherein the first bench leg of the first or second leg assembly is integrally formed with the leg-linking member.

3. The foldable frame of claim 2, further comprising:

a second bench frame disposed at a side of the table frame opposite to the first bench frame; and third and fourth linking assemblies, the third linking assembly connected to the second bench frame at the first side of the foldable frame and the fourth linking assembly connected to the second bench frame at the second side of the foldable frame, wherein:

each of the first and second leg assemblies further comprises a second bench leg shorter than the one or more table legs and connected to the one or more table legs by the leg-linking member;

the second bench leg of the first leg assembly is pivotally coupled with the third linking assembly; and the second bench leg of the second leg assembly is pivotally coupled with the fourth linking assembly, wherein the first and third linking members collectively allow the first leg assembly to rotate as one unit, the second and fourth linking members collectively allow the second leg assembly to rotate as another one unit, and when the first and second leg assemblies are unfolded, both of the first and second bench frames are positioned lower than the table frame.

4. The foldable frame of claim 3, wherein the first and second bench legs of a respective leg assembly in the first and second leg assemblies have a same length or different lengths.

5. The foldable frame of claim 1, further comprising:

a first supporting assembly pivotally connected to the first leg assembly and table frame and configured to control rotation of the first leg assembly with respect to the table frame and to help support the table frame when the first leg assembly is unfolded; and a second supporting assembly pivotally connected to the second leg assembly and table frame and configured to control rotation of the second leg assembly with respect to the table frame and to help support the table frame when the second leg assembly is unfolded.

6. The foldable frame of claim 1, wherein the first bench frame further comprises first and second bench-longitudinal members spaced apart from each other, wherein the first and second bench-lateral members are connected to or integrally formed with the first and second bench-longitudinal members; and each of the first and second linking assemblies is pivotally connected to at least one of the first and second bench-longitudinal members.

7. The foldable frame of claim 6, wherein a respective linking assembly in the first and second linking assemblies comprises:

a first linking member having a first end portion pivotally connected to the first bench-longitudinal member adjacent to a corresponding bench-lateral member in the first and second bench-lateral members; and a second linking member having a first end portion pivotally connected to the second bench-longitudinal member adjacent to the corresponding bench-lateral member, wherein the first bench leg of a corresponding leg assembly in the first and second leg assemblies is pivotally connected to second end portions of the first and second linking members.

8. The foldable frame of claim 7, wherein an engaging member is disposed at the upper end portion of the first bench leg of the corresponding leg assembly and configured to abut the corresponding bench-lateral member when the corresponding leg assembly is unfolded.

9. The foldable frame of claim 8, wherein the engaging member comprises a first segment and a second segment bended with respect to the first segment, wherein when the corresponding leg assembly is unfolded:

the first segment abuts a lower side of the corresponding bench-lateral member to support the first bench frame; and the second segment abuts an interior side of the corresponding bench-lateral member to help prevent separation of the first bench leg from the corresponding bench-lateral member or to help stabilize the first bench leg of the corresponding leg assembly.

10. The foldable frame of claim 7, wherein the corresponding linking assembly further comprises a third linking member disposed between the first and second linking member, and connected to or integrally formed with the first and second linking members.

11. A foldable frame comprising:

a table frame;

a first bench frame;

first and second linking assemblies, the first linking assembly connected to the first bench frame at a first side of the foldable frame and the second linking assembly connected to the first bench frame at a second side of the foldable frame; and first and second leg assemblies, each comprising one or more table legs, a first bench leg, and a leg-linking member connecting the first bench leg with the one or more table legs, the first bench leg having a length shorter than the one or more table legs, wherein:

the one or more table legs of the first leg assembly are pivotally coupled with the table frame at the first side of the foldable frame;

the first bench leg of the first leg assembly is pivotally coupled with the first linking assembly;

the one or more table legs of the second leg assembly are pivotally coupled with the table frame at the second side of the foldable frame; and the first bench leg of the second leg assembly is pivotally coupled with the second linking assembly;

wherein the first linking assembly allows the first leg assembly to rotate as one unit and the second linking assembly allows the second leg assembly to rotate as another one unit, and when the first and second leg assemblies are unfolded, the first bench frame is positioned lower than the table frame; and wherein a respective linking assembly in the first and second linking assemblies comprises a first bar fixedly coupled with the first bench frame and a second bar telescopically coupled with the first bar, wherein the first bench leg of a corresponding leg assembly in the first and second leg assemblies is pivotally coupled with the second bar, wherein movement of the second bar with respect to the first bar allows the corresponding leg assembly to rotate as a unit.

12. The foldable frame of claim 11, wherein the first bench frame comprises:

first and second bench-longitudinal members spaced apart in a first direction; and a plurality of bench-lateral members spaced apart in a second direction and connected to the first and second bench-longitudinal members, wherein the first bar of the corresponding linking assembly is fixedly connected to one or more bench-lateral members in the plurality of bench-lateral members.

13. The foldable frame of claim 12, wherein:

the plurality of bench-lateral members comprises first, second, third and fourth bench-lateral members;

the first bar of the first linking assembly is fixedly connected to the first and second bench-lateral members; and the first bar of the second linking assembly is fixedly connected to the third and fourth bench-lateral members.

14. The foldable frame of claim 11, wherein the first bench leg of the corresponding leg assembly is pivotally coupled with the second bar by a coupler disposed at a distal end portion of the second bar.

15. The foldable frame of claim 11, further comprising:

a second bench frame disposed at a side of the table frame opposite to the first bench frame; and third and fourth linking assemblies, the third linking assembly connected to the second bench frame at the first side of the foldable frame and the fourth linking assembly connected to the second bench frame at the second side of the foldable frame, wherein:

each of the first and second leg assemblies further comprises a second bench leg shorter than the one or more table legs and connected to the one or more table legs by the leg-linking member;

the second bench leg of the first leg assembly is pivotally coupled with the third linking assembly; and the second bench leg of the second leg assembly is pivotally coupled with the fourth linking assembly, wherein the first and third linking members collectively allow the first leg assembly to rotate as one unit, the second and fourth linking members collectively allow the second leg assembly to rotate as another one unit, and when the first and second leg assemblies are unfolded, both of the first and second bench frames are positioned lower than the table frame.

16. The foldable frame of claim 15, wherein the first and second bench legs of a respective leg assembly in the first and second leg assemblies have a same length or different lengths.

17. A foldable frame comprising:

a table frame;

a first bench frame;

first and second linking assemblies, the first linking assembly connected to the first bench frame at a first side of the foldable frame and the second linking assembly connected to the first bench frame at a second side of the foldable frame; and first and second leg assemblies, each comprising one or more table legs, a first bench leg, and a leg-linking member connecting the first bench leg with the one or more table legs, the first bench leg having a length shorter than the one or more table legs, wherein:

the one or more table legs of the first leg assembly are pivotally coupled with the table frame at the first side of the foldable frame;

the first bench leg of the first leg assembly is pivotally coupled with the first linking assembly;

the one or more table legs of the second leg assembly are pivotally coupled with the table frame at the second side of the foldable frame; and the first bench leg of the second leg assembly is pivotally coupled with the second linking assembly;

wherein the first linking assembly allows the first leg assembly to rotate as one unit and the second linking assembly allows the second leg assembly to rotate as another one unit, and when the first and second leg assemblies are unfolded, the first bench frame is positioned lower than the table frame; and wherein a respective linking assembly in the first and second linking assemblies comprises:

one or more bars each coupled with the first bench frame; and a slider coupled with the one or more bars and movable along the one or more bars, wherein the first bench leg of a corresponding leg assembly in the first and second leg assemblies is pivotally coupled with the slider, and movement of slider along the one or more bars allows the corresponding leg assembly to rotate as a unit.

18. The foldable frame of claim 17, wherein:

the one or more bars comprises first and second bars substantially parallel to each other; and the slider comprises a first sleeve to sleeve on the first bar, a second sleeve to sleeve on the second bar, and a slot between the first and second sleeves in the second direction to receive and pivotally couple with an upper end portion of the first bench leg.

19. The foldable frame of claim 17, wherein the first bench frame comprises:

first and second bench-longitudinal members spaced apart in a first direction; and first, second, third and fourth bench-lateral members spaced apart in a second direction and connected to the first and second bench-longitudinal members, wherein each of the one or more bars of the first linking assembly is fixedly connected to the first and second bench-lateral members, and each of the one or more bars of the second linking assembly is fixedly connected to the third and fourth bench-lateral members.

20. The foldable frame of claim 19, wherein:

the first and second bench-lateral members are positioned such that the slider of the first linking assembly contacts the first bench-lateral member when the first leg assembly is unfolded and contacts the second bench-lateral member when the first leg assembly is folded; and the third and fourth bench-lateral members are positioned such that the slider of the second linking assembly contacts the fourth bench-lateral member when the second leg assembly is unfolded and contacts the third bench-lateral member when the first leg assembly is folded.

21. The foldable frame of claim 17, further comprising:

a second bench frame disposed at a side of the table frame opposite to the first bench frame; and third and fourth linking assemblies, the third linking assembly connected to the second bench frame at the first side of the foldable frame and the fourth linking assembly connected to the second bench frame at the second side of the foldable frame, wherein:

each of the first and second leg assemblies further comprises a second bench leg shorter than the one or more table legs and connected to the one or more table legs by the leg-linking member;

the second bench leg of the first leg assembly is pivotally coupled with the third linking assembly; and the second bench leg of the second leg assembly is pivotally coupled with the fourth linking assembly, wherein the first and third linking members collectively allow the first leg assembly to rotate as one unit, the second and fourth linking members collectively allow the second leg assembly to rotate as another one unit, and when the first and second leg assemblies are unfolded, both of the first and second bench frames are positioned lower than the table frame.

22. The foldable frame of claim 21, wherein the first and second bench legs of a respective leg assembly in the first and second leg assemblies have a same length or different lengths.

* * * * *